US009980536B2

(12) United States Patent
Spanks et al.

(10) Patent No.: US 9,980,536 B2
(45) Date of Patent: May 29, 2018

(54) ARTICLE OF FOOTWEAR WITH A TENSIONING SYSTEM

(71) Applicant: NIKE, Inc., Beaverton, OR (US)

(72) Inventors: Jeffrey C. Spanks, Portland, OR (US); Nadia M. Panian, Beaverton, OR (US); Eric P. Avar, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 18 days.

(21) Appl. No.: 15/001,299

(22) Filed: Jan. 20, 2016

(65) Prior Publication Data

US 2017/0202310 A1 Jul. 20, 2017

(51) Int. Cl.

| | |
|---|---|
| ***A43C 5/00*** | (2006.01) |
| ***A43C 11/00*** | (2006.01) |
| ***A43B 23/02*** | (2006.01) |
| ***A43B 23/26*** | (2006.01) |
| ***A43B 3/10*** | (2006.01) |
| ***A43B 3/12*** | (2006.01) |
| ***A43B 5/00*** | (2006.01) |
| ***A43B 5/02*** | (2006.01) |
| ***A43B 5/06*** | (2006.01) |
| ***A43B 5/10*** | (2006.01) |
| ***A43B 13/04*** | (2006.01) |
| ***A43B 13/12*** | (2006.01) |

(Continued)

(52) U.S. Cl.

CPC ..... *A43B 23/028* (2013.01); *A43B 3/101* (2013.01); *A43B 3/12* (2013.01); *A43B 5/002* (2013.01); *A43B 5/02* (2013.01); *A43B 5/06* (2013.01); *A43B 5/10* (2013.01); *A43B 13/04* (2013.01); *A43B 13/122* (2013.01); *A43B 13/181* (2013.01); *A43B 13/187* (2013.01); *A43B 13/22* (2013.01); *A43B 19/00* (2013.01); *A43B 23/021* (2013.01); *A43B 23/0215* (2013.01); *A43B 23/07* (2013.01); *A43B 23/26* (2013.01); *A43C 1/04* (2013.01); *A43C 5/00* (2013.01); *A43C 11/00* (2013.01); *A43C 11/20* (2013.01)

(58) Field of Classification Search

CPC ..... A43B 23/00; A43B 23/26; A43B 23/0235; A43B 23/024; A43B 23/0245; A43B 23/0295; A43C 11/00; A43C 5/00

USPC ..... 36/50.1, 54, 133

See application file for complete search history.

(56) References Cited

U.S. PATENT DOCUMENTS

| | | | |
|---|---|---|---|
| 39,163 | A | 7/1863 | Newton |
| 2,551,723 | A | 5/1951 | Camero |

(Continued)

FOREIGN PATENT DOCUMENTS

| | | | |
|---|---|---|---|
| EP | 1256286 | A2 | 11/2002 |
| FR | 403840 | A | 6/1909 |

(Continued)

OTHER PUBLICATIONS

Apr. 20, 2017—(WO) ISR—App. No. PCT/US2017/014304.

*Primary Examiner* — Marie Bays

(74) *Attorney, Agent, or Firm* — Banner & Witcoff, Ltd.

(57) ABSTRACT

An article of footwear including a tensioning system is disclosed. The tensioning system is adjustable and includes a first layer and a second layer that is moveable and extends over the first layer. The article can include elements that are capable of distributing tension over the article. The article may include a tensile element, guide elements, and one or more strap guides attached to an underside of the second layer.

21 Claims, 12 Drawing Sheets

(51) Int. Cl.

| | |
|---|---|
| ***A43B 13/18*** | (2006.01) |
| ***A43B 13/22*** | (2006.01) |
| ***A43B 23/07*** | (2006.01) |
| ***A43C 1/04*** | (2006.01) |
| ***A43B 19/00*** | (2006.01) |
| ***A43C 11/20*** | (2006.01) |

(56) References Cited

U.S. PATENT DOCUMENTS

| | | | | | |
|---|---|---|---|---|---|
| 3,703,775 | A * | 11/1972 | Gatti | A43B 5/025 | 36/128 |
| 4,357,740 | A | 11/1982 | Brown | | |
| 4,817,303 | A | 4/1989 | Selbiger | | |
| 5,097,573 | A | 3/1992 | Gimeno | | |
| 5,117,567 | A | 6/1992 | Berger | | |
| 5,182,838 | A | 2/1993 | Stenner | | |
| 5,327,662 | A | 7/1994 | Hallenbeck | | |
| 5,463,822 | A * | 11/1995 | Miller | A43C 11/00 | 36/50.1 |
| 5,894,639 | A | 4/1999 | Boden | | |
| 5,906,057 | A * | 5/1999 | Borsoi | A43C 3/00 | 24/714.7 |
| 6,185,798 | B1 | 2/2001 | Ton | | |
| 6,189,186 | B1 | 2/2001 | Boden | | |
| 6,681,503 | B2 * | 1/2004 | Morle | A43B 5/02 | 36/133 |
| 7,124,482 | B2 | 10/2006 | Kim | | |
| 7,428,789 | B2 * | 9/2008 | Holzer | A43B 5/0411 | 36/117.2 |
| 7,574,818 | B2 | 8/2009 | Meschter | | |
| 7,631,440 | B2 * | 12/2009 | Keen | A43B 1/14 | 36/50.1 |
| 7,941,943 | B2 * | 5/2011 | Baker | A43B 5/02 | 36/133 |
| 8,141,273 | B2 | 3/2012 | Stramare | | |
| 8,266,827 | B2 | 9/2012 | Dojan | | |
| 8,484,865 | B2 * | 7/2013 | Baker | A43B 5/02 | 36/133 |
| 9,113,674 | B2 | 8/2015 | Dojan | | |
| 2002/0166260 | A1 * | 11/2002 | Borsoi | A43C 1/00 | 36/50.1 |
| 2011/0016680 | A1 | 1/2011 | Chang | | |
| 2011/0258876 | A1 * | 10/2011 | Baker | A43C 11/008 | 36/50.1 |
| 2012/0240428 | A1 * | 9/2012 | Knoll | A43B 5/0427 | 36/50.1 |
| 2014/0130270 | A1 | 5/2014 | Baudouin et al. | | |
| 2014/0130372 | A1 * | 5/2014 | Aveni | A43B 3/122 | 36/83 |
| 2014/0137432 | A1 | 5/2014 | Eldem | | |
| 2015/0089839 | A1 | 4/2015 | James | | |
| 2015/0237962 | A1 | 8/2015 | Soderberg et al. | | |

FOREIGN PATENT DOCUMENTS

| | | | |
|---|---|---|---|
| FR | 2783678 | A1 | 3/2000 |
| FR | 2902982 | A1 | 7/2006 |

* cited by examiner

ARTICLE OF FOOTWEAR WITH A TENSIONING SYSTEM

BACKGROUND

The present embodiments relate generally to articles of footwear, and in particular to articles of footwear for sports.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, the present disclosure is directed to an article of footwear, the article of footwear comprising a sole structure and an upper, the upper including a first layer and a second layer. The first layer extends through a forefoot region, a midfoot region, and a heel region of the upper, and the second layer is positioned over a distal surface of the first layer so that the second layer covers at least a portion of an instep region of the article of footwear. The article of footwear has a tensioning system, the tensioning system comprising a tensile element, a plurality of guide elements, and a plurality of strap guides. The plurality of guide elements is positioned adjacent to a periphery of the first layer of the upper, and the second layer has a proximal surface and a distal surface, where the plurality of strap guides is attached to the proximal surface of the second layer. Furthermore, the tensile element is routed through each of the plurality of guide elements and through each of the plurality of strap guides and at least a portion of the tensile element is routed between the distal surface of the first layer and the proximal surface of the second layer.

In another aspect, the present disclosure is directed to an article of footwear, the article of footwear comprising a lateral side, a medial side, a forefoot region, and an instep region, an upper and a fastening system. The upper has a first layer and a second layer, where the first layer forms an interior cavity configured to receive a foot, and where the second layer includes a flap portion and an anchored portion, a peripheral border of the anchored portion attached to the first layer in the forefoot region. The fastening system comprises a plurality of guide elements, a plurality of strap guides, and a tensile element. In addition, the upper includes a closed configuration and an open configuration, where the tensile element is routed through each of the plurality of strap guides and through each of the plurality of guide elements when the upper is in the closed configuration, and the second layer exerts a compressive force along at least a part of the instep region when the upper is in the closed configuration. Furthermore, the plurality of strap guides are disposed between the first layer and the second layer.

In another aspect, the present disclosure is directed to an article of footwear, the article of footwear comprising an upper, the upper including a bootie portion and a cover portion. The bootie portion has an interior cavity configured to receive a foot, and the cover layer is positioned over a distal surface of the bootie portion so that the cover layer extends over at least a portion of an instep region of the article of footwear. The article of footwear also includes a tensioning system, the tensioning system comprising a plurality of strap guides and a tensile element. In addition, the cover layer has a proximal surface and a distal surface, where the proximal side faces toward the distal surface of the bootie portion. Furthermore, the plurality of strap guides is attached to the proximal surface of the second layer. The plurality of strap guides include a first strap guide and a second strap guide, the first strap guide comprising of a first folded strap, the first folded strap being attached to a medial side of the proximal surface of the cover layer, and the second strap guide comprising of a second folded strap, the second folded strap being attached to a lateral side of the proximal surface of the cover layer. The first folded strap includes a first channel configured to receive a portion of the tensile element, and the second folded strap includes a second channel configured to receive a portion of the tensile element.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale; emphasis is instead being placed upon illustrating the principles of the embodiments. Moreover, in the figures, like reference numerals designate corresponding parts throughout the different views.

DETAILED DESCRIPTION

Figure 1:
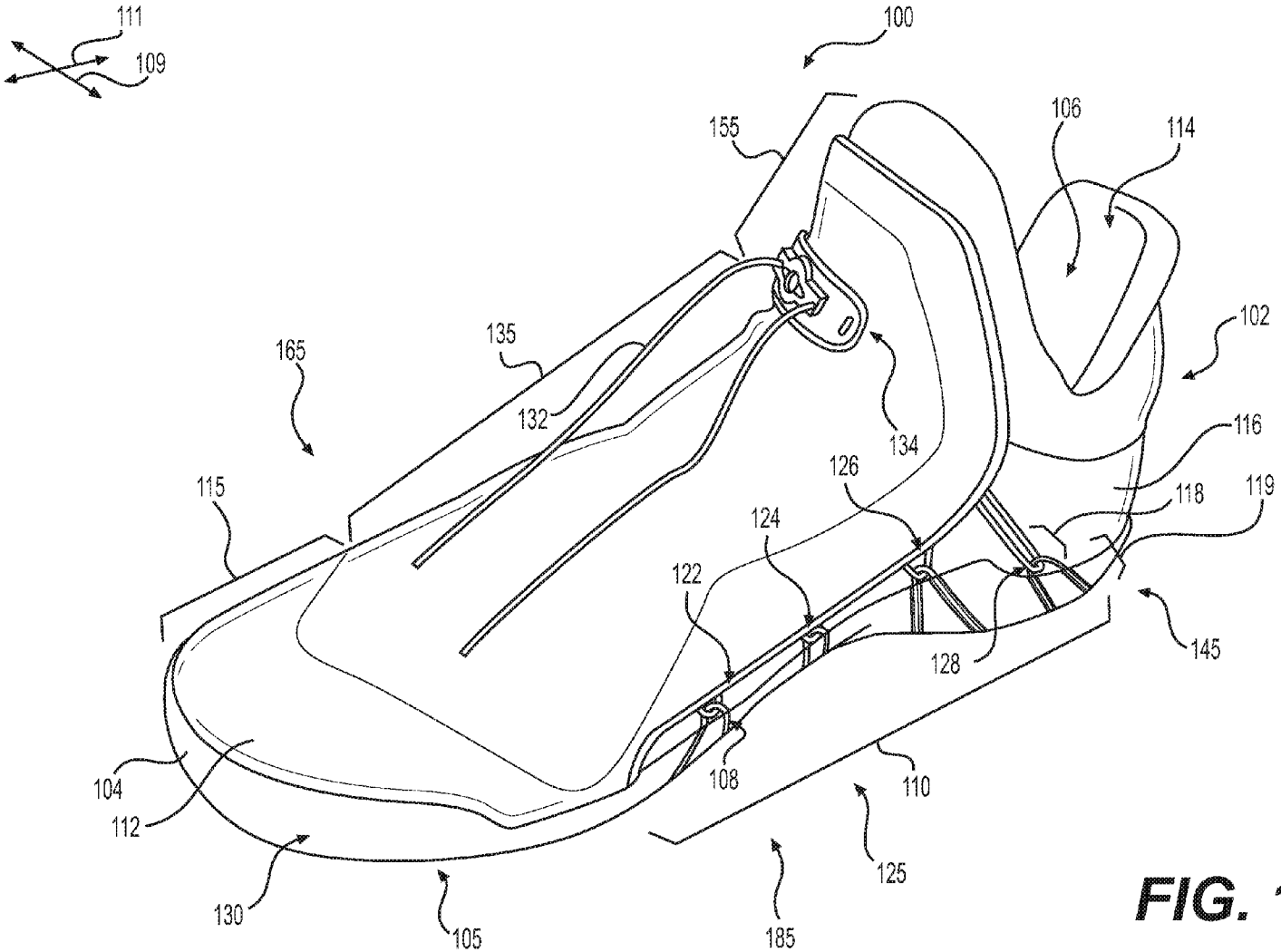
FIG. 1 is an isometric medial side view of an embodiment of an article of footwear including an upper and a sole structure.
Figure 2:
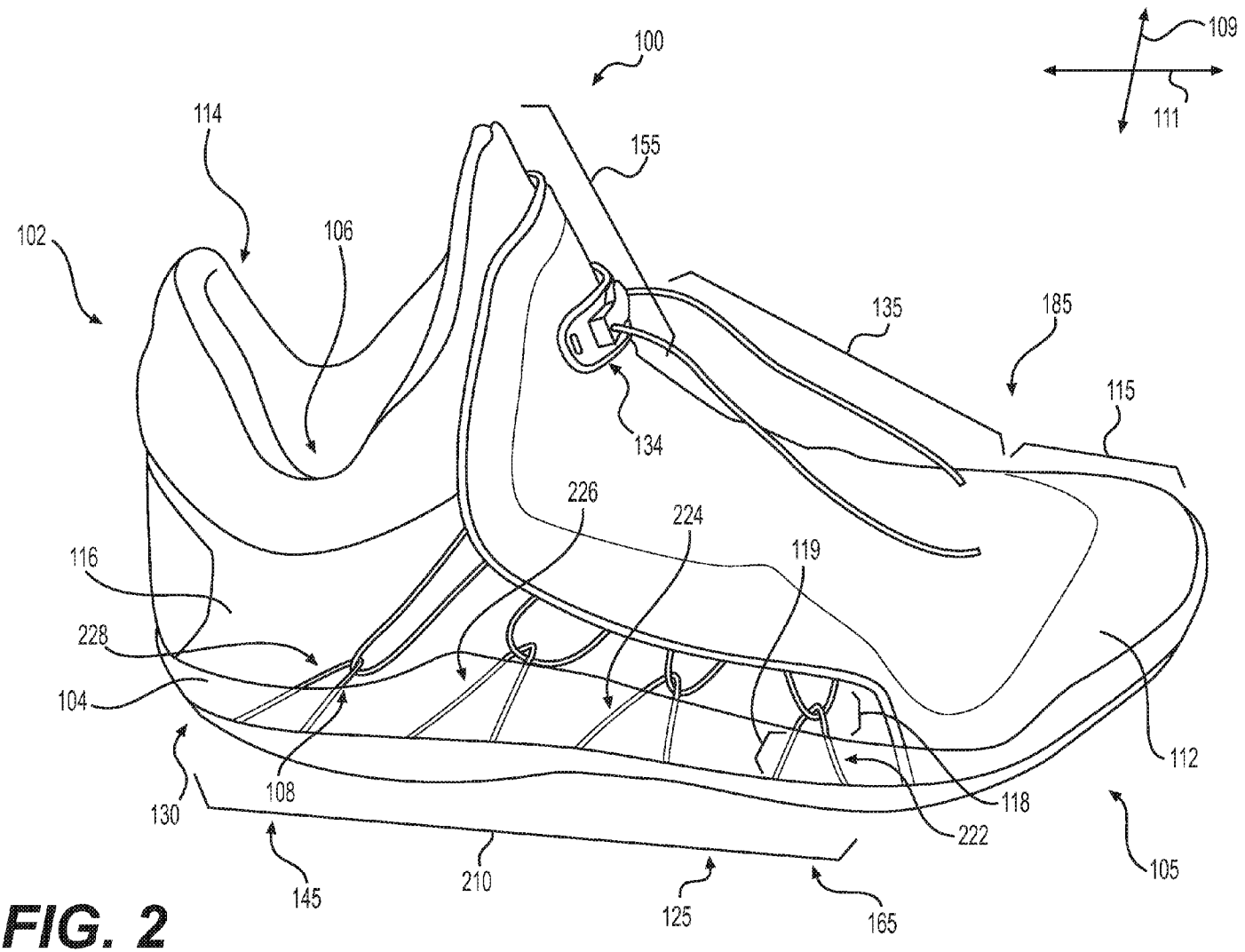
FIG. 2 is an isometric lateral side view of an embodiment of an article of footwear including an upper and a sole structure.
Figure 3:
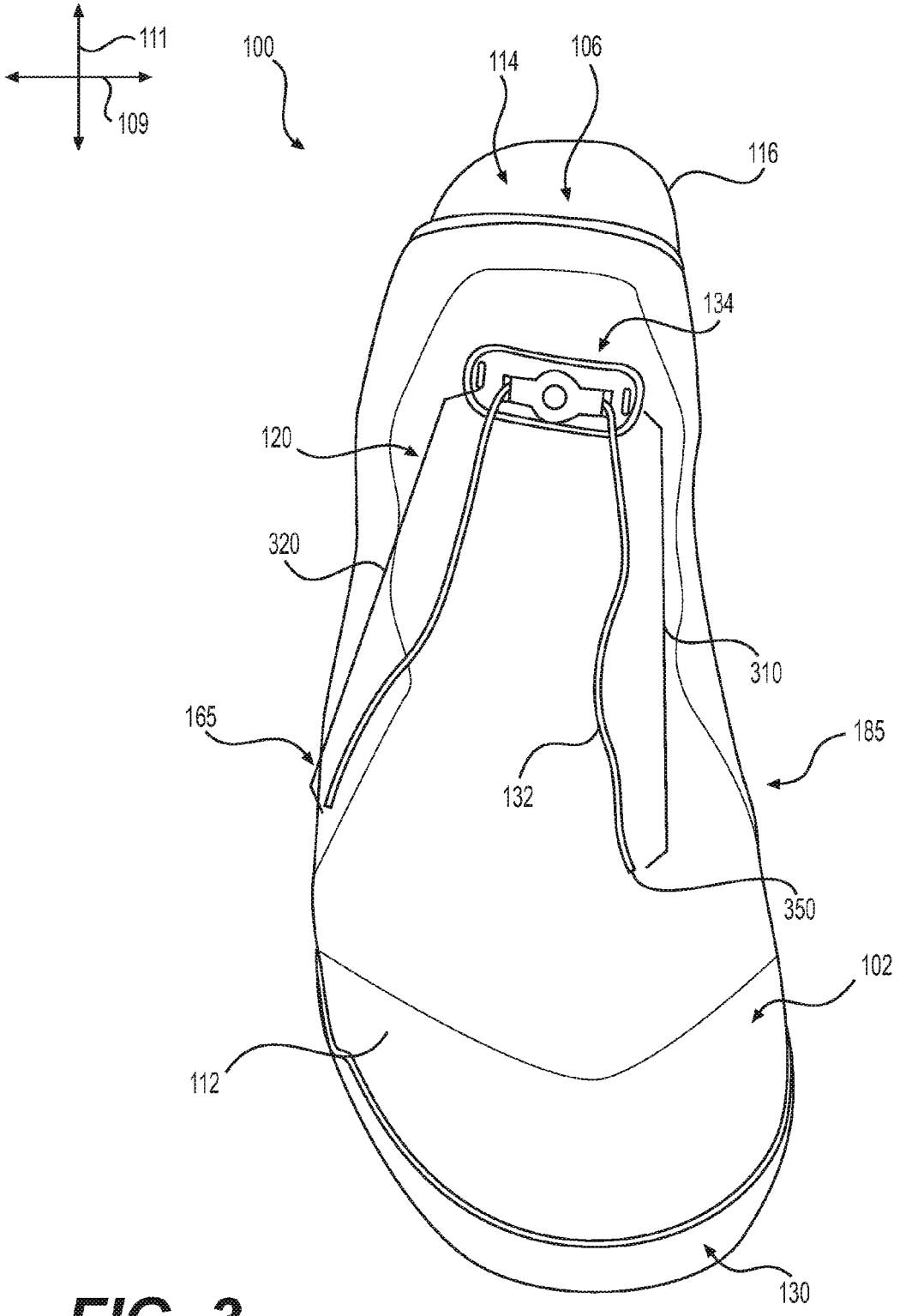
FIG. 3 is an isometric front view of an embodiment of an article of footwear including an upper and a sole structure.

FIGS. 1-3 depict isometric views of an embodiment of an article of footwear 100. In one embodiment, article of footwear 100 has the form of an athletic shoe. The provisions discussed herein for article of footwear 100 could be incorporated into various other kinds of footwear including, but not limited to, basketball shoes, hiking boots, soccer shoes, football shoes, tennis shoes, climbing shoes, sneakers, running shoes, cross-training shoes, rugby shoes, rowing shoes, baseball shoes as well as other kinds of shoes. Moreover, in some embodiments, the provisions discussed herein for article of footwear 100 could be incorporated into various other kinds of non-sports-related footwear, including, but not limited to, slippers, sandals, high-heeled footwear, and loafers.

For purposes of clarity, the following detailed description discusses the features of article of footwear 100, also referred to simply as article 100. However, it will be understood that other embodiments may incorporate a corresponding article of footwear (e.g., a right article of footwear when article 100 is a left article of footwear) that may share some, and possibly all, of the features of article 100 described herein and shown in the figures.

The embodiments may be characterized by various directional adjectives and reference portions. These directions and reference portions may facilitate in describing the portions of an article of footwear. Moreover, these directions and reference portions may also be used in describing subcomponents of an article of footwear (e.g., directions and/or portions of a midsole structure, an outer sole structure, a tensioning system, an upper, or any other components).

For consistency and convenience, directional adjectives are employed throughout this detailed description corresponding to the illustrated embodiments. The term "longitudinal" as used throughout this detailed description and in the claims refers to a direction or axis extending a length of a component (e.g., an upper or sole component). In some embodiments, a longitudinal direction may extend from a forefoot portion to a heel portion of the component. Also, the term "lateral" as used throughout this detailed description and in the claims refers to a direction or axis extending along a width of a component. For example, a lateral direction may extend between a medial side and a lateral side of a component. Furthermore, the term "vertical" as used throughout this detailed description and in the claims refers to a direction or axis generally perpendicular to a lateral and longitudinal direction. For example, in embodiments where an article is planted flat on a ground surface, a vertical direction may extend from the ground surface upward. Additionally, the term "inner" or "proximal" refers to a portion of an article disposed closer to an interior of an article, or closer to a foot when the article is worn. Likewise, the term "outer" or "distal" refers to a portion of an article disposed further from the interior of the article or from the foot. Thus, for example, the proximal surface of a component is disposed closer to an interior of the article than the distal surface of the component. This detailed description makes use of these directional adjectives in describing an article and various components of the article, including an upper, a midsole structure, and/or an outer sole structure.

Article 100 may be characterized by a number of different regions or portions. For example, article 100 could include a forefoot portion, a midfoot portion, a heel portion, a vamp portion, and an instep portion. Moreover, components of article 100 could likewise comprise corresponding portions. Referring to FIG. 1, article 100 may be divided into a forefoot region 105, a midfoot region 125, and a heel region 145. Forefoot region 105 may be generally associated with the toes and joints connecting the metatarsals with the phalanges. Midfoot region 125 may be generally associated with the arch of a foot. Likewise, heel region 145 may be generally associated with the heel of a foot, including the calcaneus bone. Article 100 may also include a vamp region 115 and an instep region 135. Vamp region 115 may be generally associated with the front and middle part of a shoe upper that covers the part of the foot adjacent to the toes, and can encompass portions of both forefoot region 105 and midfoot region 125. Furthermore, instep region 135 may be generally associated with the upper, center section of the foot, between the toes and ankle, adjacent to vamp region 115, and can encompass portions of both midfoot region 125 and heel region 145. In addition, in some embodiments, article 100 may also include an ankle region 155 that is associated with the rear portion of an article of footwear, including the region around the opening providing access to the interior of the shoe.

Furthermore, for purposes of reference, article 100 may include a lateral side 165 and a medial side 185. In particular, lateral side 165 and medial side 185 may be opposing sides of article 100. Furthermore, both lateral side 165 and medial side 185 may extend through forefoot region 105, midfoot region 125, heel region 145, vamp region 115, instep region 135, and ankle region 155.

FIGS. 1-3 illustrate various features and components of article of footwear 100, including an upper 102 and a sole structure 130. FIG. 1 provides an isometric lateral side view of an embodiment of article 100. FIG. 2 provides an isometric medial side view of an embodiment of article 100. FIG. 3 provides an isometric front view of an embodiment of article 100. Depending on the material of upper 102, in some embodiments, upper 102 may be configured to stretch fit over a foot without the need for fasteners or guide elements. However, in other embodiments, the use of one or more guide elements 108, shown here attached to adjacent to a lower periphery of upper 102, may provide a mechanism for routing a tensile element 132 over upper 102 and facilitate adjustments to the amount of tension associated with article 100. Some embodiments of a tensioning system will be discussed further below.

Furthermore, in different embodiments, sole structure 130 may be configured to provide traction for article 100. Thus, in some embodiments, traction elements may be included in sole structure 130. In addition to providing traction, sole structure 130 may attenuate ground reaction forces when compressed between the foot and the ground during walking, running, pushing, or other ambulatory activities. The configuration of sole structure 130 may vary significantly in different embodiments to include a variety of conventional or nonconventional structures. In some embodiments, the configuration of sole structure 130 can be configured according to one or more types of surfaces on which sole structure 130 may be used. Examples of surfaces include, but are not limited to, natural turf, synthetic turf, dirt, hardwood flooring, skims, wood, plates, footboards, boat ramps, as well as other surfaces.

The various portions of sole structure 130 may be formed from a variety of materials. For example, sole structure 130 may include a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, sole structure 130 may incorporate fluid-filled chambers, plates, moderators, or other elements that further attenuate forces, enhance stability, or influence the motions of the foot. Furthermore, other portions of sole structure 130, such as an outsole, can be formed from a wear-resistant rubber material that is textured to impart traction. It should be understood that the embodiments herein depict a configuration for sole structure 130 as an example of a sole structure that may be used in connection with upper 102, and a variety of other conventional or nonconventional configurations for sole structure 130 may also be utilized. Accordingly, the structure and features of sole structure 130 or any sole structure utilized with upper 102 may vary considerably.

Sole structure 130 is secured to upper 102 and extends between a foot and the ground when article 100 is worn. In different embodiments, sole structure 130 may include different components. For example, sole structure 130 may include an outsole. Sole structure 130 may further include a midsole and/or an insole. In some embodiments, one or more of these components may be optional. In addition, sole structure 130 may include components or portions that extend toward and/or attach to a portion of upper 102. Such components may provide additional support and compressive strength to article 100. For example, a sidewall 104 or a portion of an outsole may extend along or be disposed adjacent to a portion of lateral side 165 or medial side 185 of upper 102. In some embodiments, sidewall 104 may extend along or be disposed adjacent to various portions of upper 102. In FIGS. 1-2, sidewall 104 is integrally joined to sole structure 130 and is also disposed adjacent to upper 102. In one embodiment, sidewall 104 may extend or surround portions of heel region 145 and/or midfoot region 125. In other embodiments, sidewall 104 may extend from a downwardly-facing outsole to a side portion of upper 102. Sidewall 104 can also be used to anchor or fortify various elements or areas of article 100 in different embodiments. For example, in one embodiment, a portion of sidewall 104 can act as a heel counter. While sidewall 104 may be substantially smooth in some embodiments, in other embodiments, sidewall 104 may include regions with increased curvature, dimpling, protrusions, insignia, or other structural formations. Furthermore, in some embodiments, portions of sole structure 130 may be either substantially opaque, translucent, or generally clear (i.e., transparent).

In different embodiments, upper 102 may be joined to sole structure 130 and define an interior cavity 106 designed to receiver a wearer's foot. In some embodiments, upper 102 includes a mouth 114 that provides access for the foot into interior cavity 106 of upper 102. Mouth 114 may be disposed along or near the ankle portion in some embodiments. Furthermore, in some embodiments, as noted above, tensile element 132 can extend through various apertures, guide elements, or other securing elements and permit the wearer to modify dimensions of upper 102 to accommodate the proportions of the foot. More particularly, a tensile element may permit the wearer to tighten portions of upper 102 around the foot, and tensile element 132 can permit the wearer to loosen upper 102 to facilitate entry and removal of the foot from mouth 114. In alternative embodiments, upper 102 may include other lace-receiving elements, such as straps, loops, eyelets, and D-rings.

Upper 102 may generally incorporate various provisions associated with uppers. Upper 102 may also be characterized by one or more layers disposed adjacent to one another. In some embodiments, each layer of upper 102 can be configured to provide various degrees of cushioning, tension, ventilation, shock absorption, energy return, support, as well as possibly other provisions.

For example, in some embodiments, upper 102 may include one or more layers, such as a first layer such as a base layer, and/or a second layer such as an outer liner or cover layer. Referring to FIGS. 1-3, in one embodiment, article 100 includes a first layer 116, and a second layer 112. First layer 116 may be disposed closest to a foot when article 100 is worn by a user. In some embodiments, first layer 116 can serve as a sockliner or a bootie. In another embodiment, first layer 116 can comprise the most rigid portion of upper 102. In one embodiment, first layer 116 has a greater thickness than other layers of upper 102. In some embodiments, first layer 116 has a proximal surface and an opposite facing distal surface. As shown in the Figures, the proximal surface is an interior facing side that defines interior cavity 106 of first layer 116. In addition, the distal surface presents an exterior facing side (or outermost facing side) of first layer 116.

In addition, upper 102 may include second layer 112 that is disposed adjacent, along or against a portion of the distal surface of first layer 116. Second layer 112 can be disposed further away or distally from interior cavity 106 than first layer 116. Second layer 112 can extend over only some portions of first layer 116 in some embodiments, or second layer 112 can be disposed such that it covers substantially all of the outer or exterior surface of first layer 116. In some embodiments, second layer 112 may comprise at least a portion of the distal (outermost) or exposed surface of upper 102. For example, in FIGS. 1-2, second layer 112 is disposed along vamp region 115, instep region 135, and ankle region 155. Second layer 112 may also disposed be adjacent to sidewall 104 along forefoot region 105, midfoot region 125, and portions of heel region 145 of upper 102. In some embodiments, second layer 112 has a greater stiffness than the material comprising first layer 116, though in other embodiments, the stiffness of outer liner 112 may be greater or substantially similar to the stiffness of first layer 116. In one embodiment, second layer 112 may be substantially water-resistant or water-repellent.

In different embodiments, each of the materials that may comprise the layer(s) of upper 102 can include various properties. The various portions of upper 102 may be formed from one or more of a plurality of material elements (e.g., textiles, polymer sheets, foam layers, leather, synthetic leather, knitted fabrics, etc.) that are stitched together or otherwise laid or disposed adjacent to one another to form upper 102. Other materials that could be used in various embodiments include, but are not limited to, expanded rubber, foam rubber, various kinds of foams, polyurethane, nylon, Gore-Tex, leather, plastic, textiles, as well as possibly other materials. Other parts of upper 102 may be made from any of a plurality of materials or combination of materials, such as leather, leather-like materials, polymer materials, plastic materials, and textile fabrics and materials.

In addition, each of the layers comprising upper 102 may be formed from any generally two-dimensional material. As utilized with respect to the present invention, the term "two-dimensional material," or variants thereof, is intended to encompass generally flat materials exhibiting a length and a width that are substantially greater than a thickness. Accordingly, suitable materials for upper layers (e.g., first layer 116 and second layer 112) include various textiles, polymer sheets, or combinations of textiles and polymer sheets, for example. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven or knitted fabric. The textiles may incorporate fibers that are arranged to impart one-directional stretch or multidirectional stretch, and the textiles may include coatings that form a breathable and water-resistant barrier, for example. The polymer sheets may be extruded, rolled, or otherwise formed from a polymer material to exhibit a generally flat aspect. Two-dimensional materials may also encompass laminated or otherwise layered materials that include two or more layers of textiles, polymer sheets, or combinations of textiles and polymer sheets. In addition to textiles and polymer sheets, other two-dimensional materials may be utilized for upper 102. Although two-dimensional materials may have smooth or generally untextured surfaces, some two-dimensional materials will exhibit textures or other surface characteristics, such as dimpling, protrusions, ribs, or various patterns, for example. Despite the presence of surface characteristics, two-dimensional materials remain generally flat and exhibit a length and a width that are substantially greater than a thickness. In some configurations, mesh materials or perforated materials may be utilized for the upper. For example, first layer 116 and/or second layer 112 may comprise a mesh material, which may impart greater breathability or air permeability to article 100.

Referring to FIGS. 1-3, in some embodiments, article 100 can include provisions for helping to secure or fasten upper 102 and sole structure 130 to a foot. In some embodiments, article 100 includes a tensioning system 120. Tensioning system 120 can help article 100 assume an expanded, loose, unsecured, or open state, where the user's foot can be readily inserted or removed from interior cavity 106 via mouth 114, and a contracted, secured, closed, or tightened state, where a user's foot is or may be fully secured within interior cavity 106.

In different embodiments, tensioning system 120 could incorporate various fastening provisions including tensile elements, straps, clasps, buckles, straps, cables, guide elements, zippers, or other kinds of components that may help secure upper 102 around a foot. For example, in some embodiments, tensioning system 120 may include one or more guide elements 108, as noted above. In one embodiment, guide elements 108 may comprise a looped portion formed by an elongated cable, tensile element, strand, or strand-like element that is at least partially fixedly attached to a portion of the upper 102 and/or sole structure 130. Furthermore, tensioning system 120 can include a clasp mechanism 134, shown in FIGS. 1-3 adjacent to second layer 112 of upper 102 and engaged with tensile element 132.

For purposes of this description, "fixedly attached" refers to an attachment between portions of different elements or materials where the portions are intended to remain attached during use of the article. In some embodiments, this may be referred to as permanently attached. Fixedly attached may be contrasted with surfaces that are adjustable or moveable, where components or materials are intended or readily capable of moving relative to one another. The fixed attachment may be formed through sewing, stitching, fusioning, bonding, gluing (by an adhesive or other agents), compressing, or a combination of thereof. In some embodiments, sidewall 104 may include provisions that strengthen or facilitate the attachment of guide elements 108 with article 100. In FIGS. 1 and 2, for example, guide elements 108 comprise a free portion 118 and a fixed portion 119. Fixed portion 119 comprises the portion of each guide element that is fixedly attached to upper 102. Fixed portion 119 may provide greater reinforcement to tensioning system 120. Further, fixed portion 119 can act as an anchoring region for tensioning system 120 in some embodiments. In FIGS. 1 and 2, fixed portion 119 is also disposed beneath sidewall 104. In other words, in some embodiments, fixed portion 119 may be disposed between a distal or outermost surface of upper 102 and sidewall 104.

As noted above, each guide element 108 can also include a free portion 118. For purposes of this disclosure, "free" refers to the ability of an element or material to be moved or adjusted. Thus, free portion 118 may be adjusted or otherwise moved to the extent permitted by the disposition of fixed portion 119. Free portion 118 may comprise a substantially curved or U-shaped element including an opening. In different embodiments, free portion 118 of guide elements 108 may be used to position or direct a portion of tensile element 132 along a specific orientation, as will be discussed further below.

Thus, in different embodiments, there may be a plurality of guide elements 108 attached to different portions of article 100. In some embodiments, there may be guide elements 108 attached to either medial side 185 or lateral side 165 of article. In other embodiments, as shown in FIG. 1, guide elements 108 include a medial guide set 110 arranged along medial side 185. In some embodiments, medial guide set 110 can comprise a first medial guide 122, a second medial guide 124, a third medial guide 126, and a fourth medial guide 128, arranged along a direction substantially aligned with a longitudinal axis 111 on the medial side of first layer 116 of upper 102 adjacent to sidewall 104. Furthermore, referring to FIG. 2, in some embodiments, guide elements 108 can include a lateral guide set 210 arranged along lateral side 165. Lateral guide set 220 can comprise a first lateral guide 222, a second lateral guide 224, a third lateral guide 226, and a fourth lateral guide 228, arranged along a direction substantially aligned with a longitudinal axis 111 on the lateral side of first layer 116 of upper 102 adjacent to sidewall 104. In some embodiments, each guide element may be "paired" such that there is a medial side guide element and—arranged along a direction substantially aligned with a lateral axis 109—a lateral guide element on the other side of the upper. Thus, in one embodiment, first lateral guide 222 and first medial guide 122 can comprise a pair, second lateral guide 224 and second medial guide 124 can comprise a pair, third lateral guide 226 and third medial guide 126 can comprise a pair, and fourth lateral guide 228 and fourth medial guide 128 can comprise a pair. Thus, in some embodiments, medial guide set 110 can be substantially symmetric with respect to lateral guide set 210. In other embodiments, guide elements 108 may be joined to only one side of upper 102, or there may be fewer guide elements on one side (e.g., the medial side or the lateral side) relative to the opposing side, or each pair may not be aligned along lateral axis 109. For example, in some embodiments, the guide elements can be attached to upper 102 to form a staggered arrangement. In other embodiments, there may be no guide elements joined to upper 102.

For purposes of this description, the term "symmetric" is used to characterize a fastening system that has a symmetry about some common axis. In other words, the medial side of tensioning system 120 can be substantially similar to the lateral side of tensioning system 120. In one embodiment, the symmetric configuration represents each of the lateral side and medial side of the fastening system being a mirror image of the other.

As shown in FIGS. 1-3, article 100 may include provisions for further securing various portions of guide elements 108 and/or fastening elements. In different embodiments, tensile element 132 may include a first end portion 310 and a second end portion 320, representing the portions of tensile element 132 that is substantially free and exposed in tensioning system 120. In other words, first end portion 310 and second end portion 320 may be associated with the maximum amount of lace that can potentially be utilized by the remainder of tensioning system 120 to provide a loosening of article 100. In different embodiments, the length of first end portion 310 and/or second end portion 320 may be greater or less than that depicted here. Furthermore, the length of first end portion 310 may be substantially similar to second end portion 320 (as shown in FIG. 3) in the secured state, or they may differ from one another. For purposes of this disclosure, the length of first end portion 310 and/or second end portion 320 represents the distance from clasp mechanism 134 to end points 350 (shown here with respect to first end portion 310) of tensile element 132. Thus, in the embodiments depicted in FIGS. 1-3, a single tensile element (shown herein as a lace) is shown routed through tensioning system 120. However, it should be understood that, in other embodiments, there may be two or more tensile elements with multiple end portions and/or available slack.

Additionally, as noted above, FIGS. 1-3 represent a secured or closed state of article 100, in which article 100 is deemed to be fully tensioned and ready for use by a given user. In some cases, a user may desire to loosen or adjust the fit and tension associated with article. Article 100 may include provisions for securing, removing, or otherwise adjusting the fit of a foot in article 100. Referring to FIGS. 4-8, a sequence of figures depicting the loosening of an embodiment of tensioning system 120 is shown. Tensioning system 120 and/or upper 102 may include a secured state (depicted in FIGS. 1-3), where article 100 is closed and/or tightened. In the secured state, tensile element 132—in conjunction with first layer 116 and second layer 112—may exert a compressive force or tension along instep region 135 and/or vamp region 115, as well as a portion of ankle region 155 in some cases. However, tensioning system 120 and/or upper 102 may include an open state, where article 100 has been loosened, and various components (e.g., portions of first layer 116, second layer 112, tensile element 132) are free to move or expand in different directions. In one embodiment, a user may adjust tensile element 132 to adjust the fit of a foot in article 100 (or remove a foot from article 100) and transition article 100 from the secured or closed state to the loosened or open state.

It should be understood that the following figures are for purposes of illustration only, and each of the components described above with respect to FIGS. 1-3 may be included or referred to in the description while not illustrated in the figures.

In some embodiments, as noted above with respect to the various guide elements, tensile element 132 may engage with elements or materials disposed in different areas of upper 102. Thus, upper 102 may include additional or different provisions for routing tensile element 132 (beyond guide elements 108 of first layer 116 as shown in FIGS. 1 and 2) in different embodiments. For example, referring to FIGS. 3 and 4, in some embodiments, tensioning system 120 includes clasp mechanism 134. In some embodiments, a user may adjust or manipulate clasp mechanism 134 to shift the position of tensile element 132 and/or to create slack in tensioning system 120, transitioning article 100 from the secured state to the open state. In some embodiments, tensile element 132 or other aspects of article 100 as described herein may be utilized with or refer to any of the techniques, concepts, features, elements, methods, and/or components of Spanks et al., U.S. Patent Publication Number US-2017-0202313-A1, published Jul. 20, 2017, (previously U.S. patent application Ser. No. 15/001,306, filed Jan. 20, 2016), titled "A Fastening Mechanism For Use With A Lacing Element."

Figure 4:
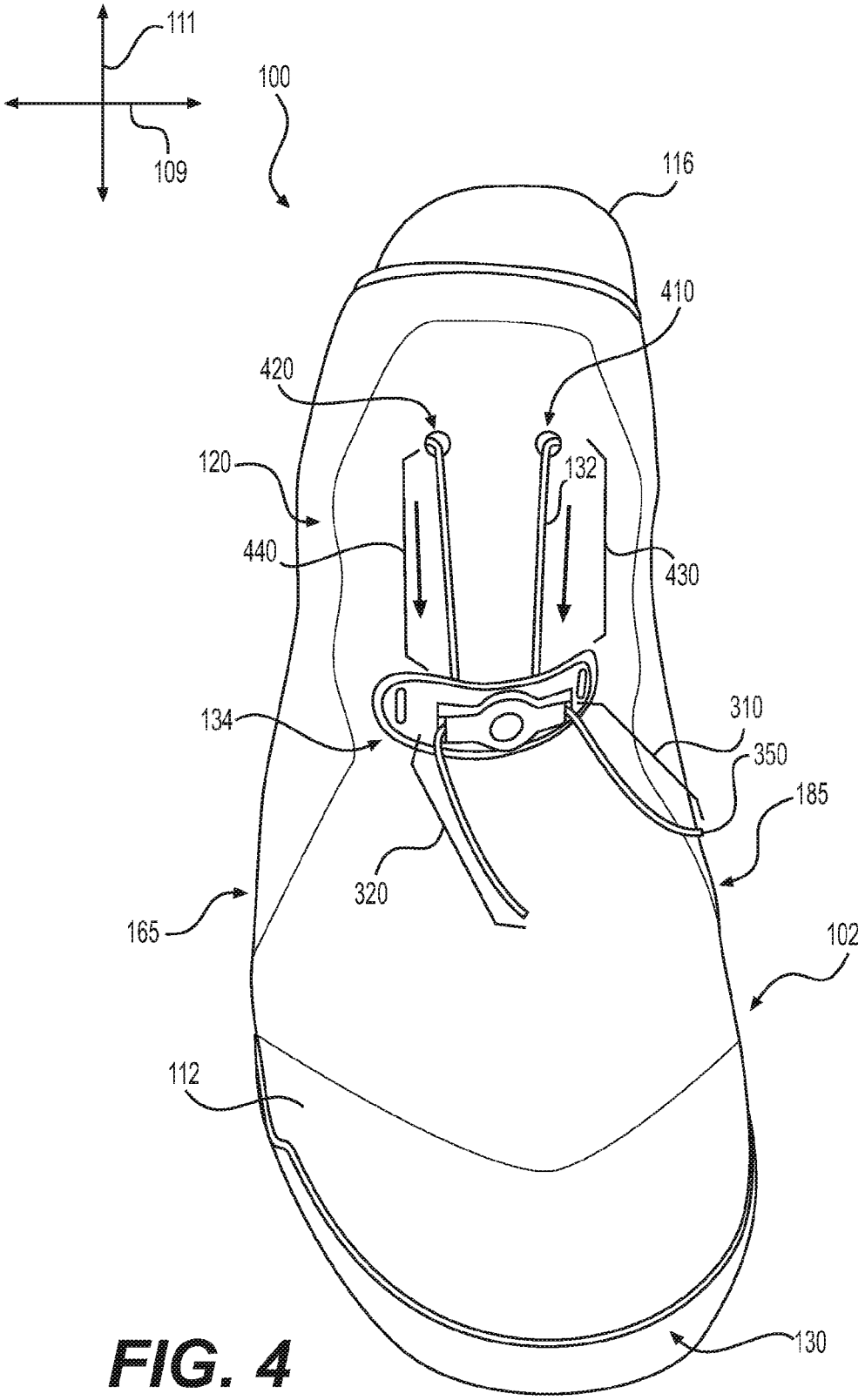
FIG. 4 is an isometric front view of an embodiment of an article of footwear including a tensioning system being loosened.

One embodiment of a transition process from the secured to loosened state is depicted in the sequence of FIGS. 4-8. In FIG. 4, clasp mechanism 134 has been pulled or slid along the two end portions of tensile element 132, decreasing the lengths of first end portion 310 and second end portion 320, and similarly increasing the amount of slack available to tensioning system 120, such that tensioning system 120 is no longer in the secured state (the secured state being illustrated in FIGS. 1-3).

In different embodiments, as clasp mechanism 134 is moved toward the end points of tensile element 132 (e.g., end points 350), the tensile element may comprise a first slack portion 430 and a second slack portion 440, representing the portions of tensile element 132 that are free to be utilized by the remainder of tensioning system 120 and routed through the routing elements (e.g., the guide elements or, as will be discussed below, the strap guides). In other words, first slack portion 430 and second slack portion 440 may be associated with the amount of lace that is ready and available for the remainder of tensioning system 120 to permit a slack or loosening in the article 100 to occur. In different embodiments, the length of first slack portion 430 and second slack portion 440 may be greater or less than that depicted here. Furthermore, the length of first slack portion 430 may be substantially similar to second slack portion 440, or they may differ from one another. For purposes of this disclosure, the length of first slack portion 430 and/or second slack portion 440 represents the distance from clasp mechanism 134 to the interface within second layer 112. In some embodiments, the interface can comprise one or more apertures. In FIG. 4, second layer 112 includes a first aperture 410 and a second aperture 420. In different embodiments, each aperture can be configured to receive a portion of tensile element 132. The size and shape of the apertures can vary, and each aperture may comprise different dimensions. In the embodiment of FIG. 4, first aperture 410 and second aperture 420 comprise substantially round holes or openings within the thickness of second layer 112. Furthermore, each aperture can have a size (i.e., cross-sectional area) substantially similar to or larger than the width or cross-sectional area of tensile element 132, facilitating a smooth movement or passage of the lace with respect to the aperture.

Figure 5:
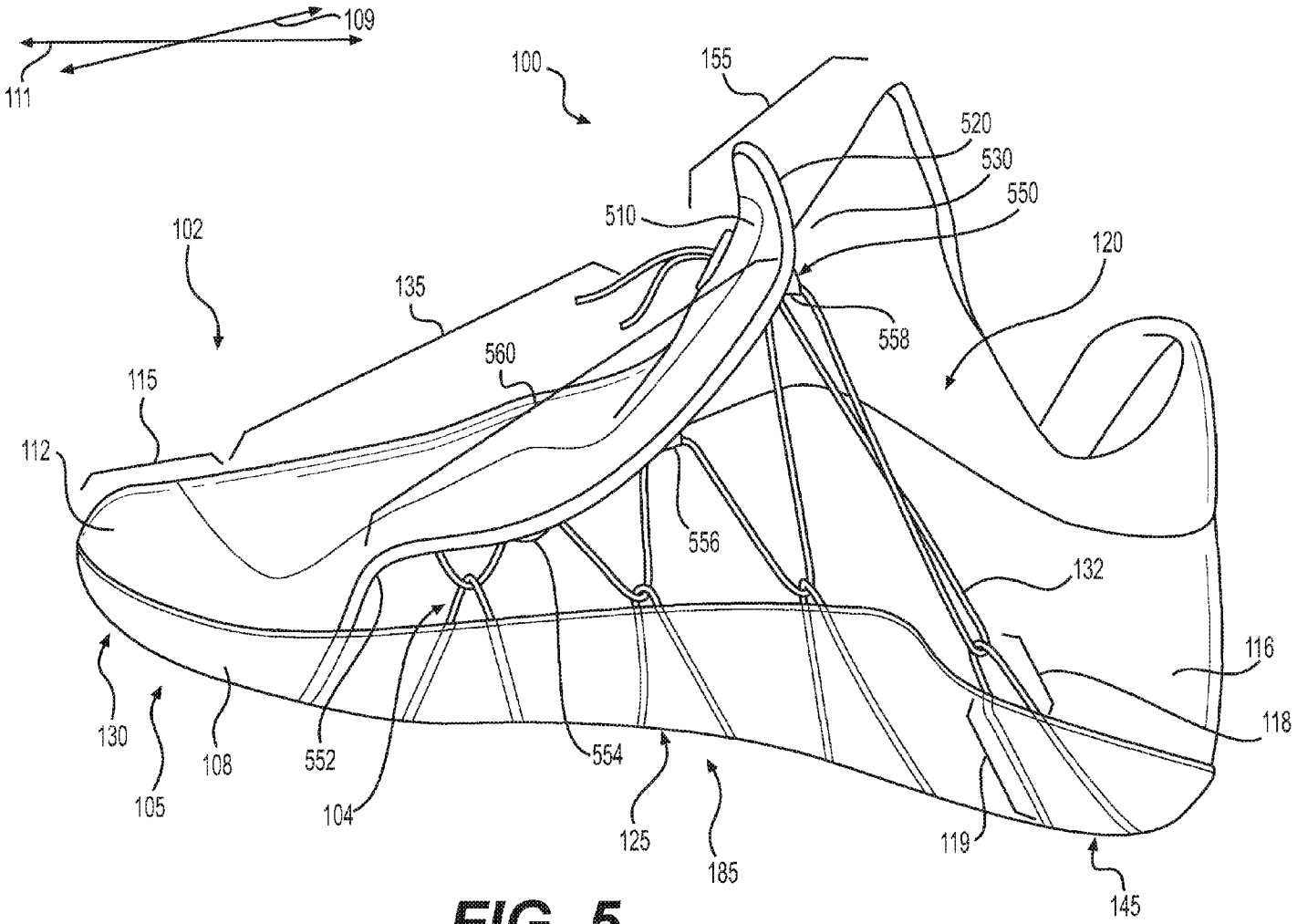
FIG. 5 is an isometric view of an embodiment of an article of footwear including a tensioning system as the tension is adjusted.

Referring now to the medial side view of FIG. 5, article 100 is shown as it further transitions from the open state to a fully loosened state. This can allow additional dimensions of article 100 to be further adjusted or widened. Thus, the embodiments of FIGS. 4-7 depict various levels or degrees of loosening that can be associated with tensioning system 120. It should be understood that a user may cease loosening article 100 at any time, and article 100 can be identified as comprising an open state where a foot may no longer be optimally secured in the article. However, a fully loosened state is one in which the article has been loosened to the maximum extent possible by the fastening system. With each enlargement of upper 102 as described herein, a user may be able to more readily slip on article 100 or remove article 100.

In FIG. 5, the medial side view depicts a view of a proximal side 520 and an opposing distal side 510 of second layer 112. Proximal side 520 may be understood to generally face toward an outermost or distal surface 530 of first layer 116. In some embodiments, proximal side 520 directly contacts distal surface 530 of first layer. For example, during the closed or secured configuration depicted in FIGS. 1-3, a substantial portion of proximal side 520 can contact or press against distal surface 530. Furthermore, in some embodiments, as will be discussed in greater detail below with respect to FIG. 10, it can be seen that the underside (in other words, proximal side 520) of second layer 112 can include one or more strap guides 550.

Figure 6:
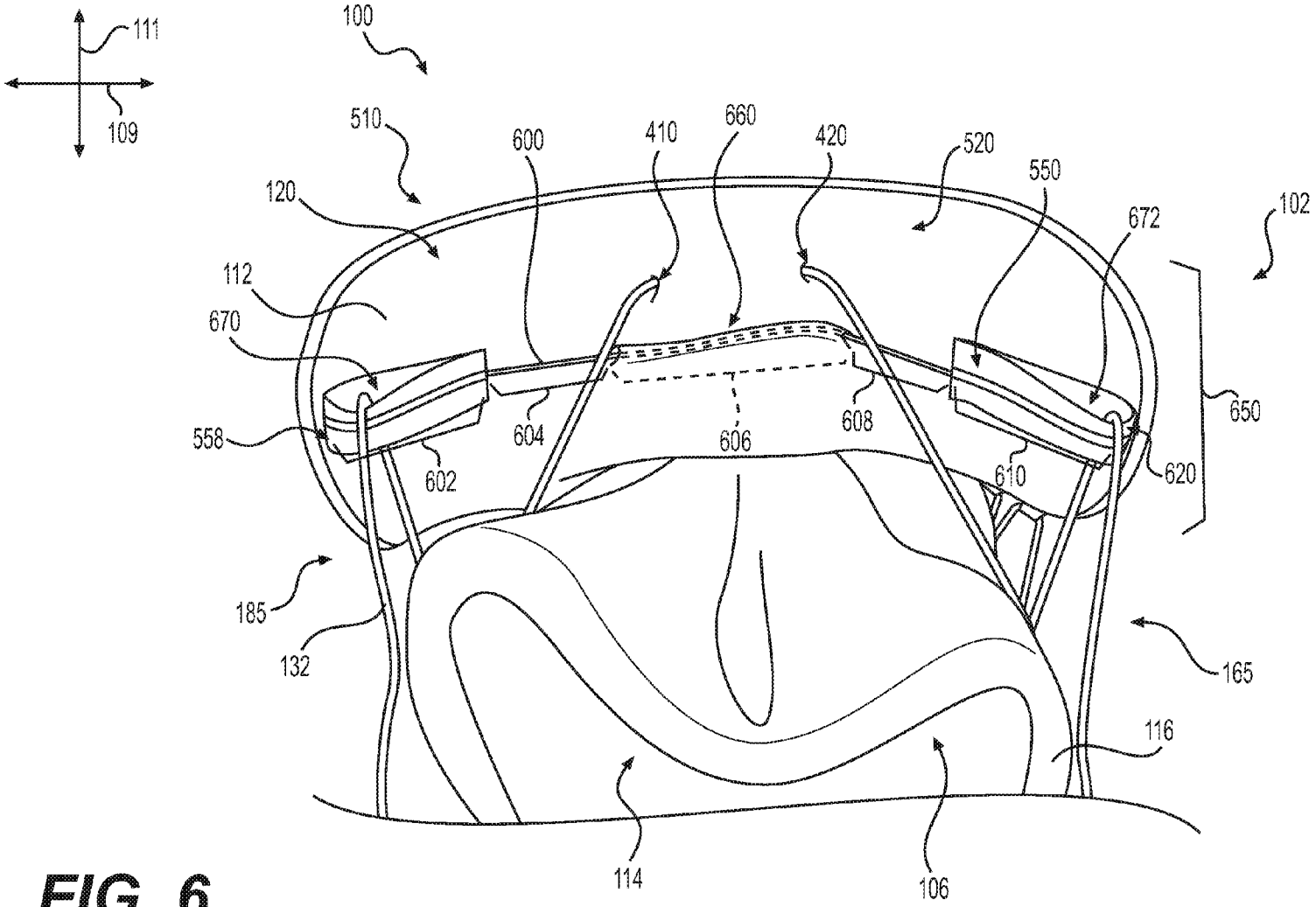
FIG. 6 is an isometric view of an embodiment of an article of footwear including a tensioning system as the tension is adjusted.

Strap guides 550 can be substantially similar to guide elements 108 in some embodiments. However, in other embodiments—as depicted in FIG. 6—strap guides 550 can comprise a folded strap or substantially two-dimensional portion of material that is at least partially attached to upper 102, forming a looped region configured to receive a portion of tensile element 132. In FIG. 5, strap guides 550 comprise at least a medial strap set 560 including a first strap guide 552, a second strap guide 554, a third strap guide 556, and a fourth strap guide 558 arranged along a direction substantially aligned with longitudinal axis 111 on the medial side of proximal side 520 of second layer 112 of upper 102. As will be discussed further below with respect to FIG. 10, strap guides 550 may also (or alternatively) comprise one or more strap guides 550 that are attached to lateral side 165 of second layer 112 in some embodiments. For example, in some embodiments, article 100 also includes a lateral strap set that is substantially similar to medial strap set 560, where the lateral strap set is arranged along lateral side 165 of second layer 112. Thus, it should be understood that details or features directed to strap guides herein may also apply to additional strap guides that will be identified in later figures.

Strap guides 550 in FIGS. 5 and 6 are fixedly attached to proximal side 520 of second layer 112. Thus, in some embodiments (such as the secured state of FIGS. 1-3), strap guides 550 may be disposed, positioned, or "sandwiched" between distal surface 530 of first layer 116 and proximal side 520 of second layer 112. Referring to FIG. 6, it can be seen that a top portion 650 of second layer 112 includes fourth strap guide 558 on medial side 185 and a fifth strap guide 620 on lateral side 165 of proximal side 520. Fourth strap guide 558 forms a first channel 670 configured to receive a portion of tensile element 132, and fifth strap guide 620 forms a second channel 672 configured to receive a portion of tensile element 132. It can be seen that each channel formed in the strap guides (e.g., first channel 670 and second channel 672) has a size or circumference large enough to accommodate the tensile element. In some embodiments, the size of a channel may be substantially larger than the thickness of the tensile element. In one embodiment, the channel can be sized to provide an opening large enough for the tensile element to move or slide within the channel in a direction substantially aligned with lateral axis 109. In some embodiments, this feature can allow tensioning system 120 to adjust the tension associated with upper 102 and surrounding interior cavity 106, providing the system with the flexibility to adjust to varying foot sizes, shapes, and volumes.

In different embodiments, tensioning system 120 may include other components. For example, extending in a direction substantially aligned with lateral axis 109, a first reinforcing element 600 is shown in FIG. 6. First reinforcing element 600 can vary in length in different embodiments. For purposes of reference, first reinforcing element 600 can comprise multiple regions or segments. As shown in FIG. 6, first reinforcing element 600 has a first segment 602, a second segment 604, a third segment 606, a fourth segment 608, and a fifth segment 610. In some embodiments, first segment 602 can be joined to or fixedly attached to at least a portion of fourth strap guide 558, and fifth segment 610 can be joined to or fixedly attached to at least a portion of fifth strap guide 620. In some embodiments, the incorporation of a portion of first reinforcing element 600 with the strap guides can strengthen or reinforce the resistance of the strap guide to stretch and/or help minimize wear and tear as the tensile element moves through the strap guide. In addition, in some embodiments, the attachment of first segment 602 to fourth strap guide 558 can help ensure that tensile element 132 is securely routed through the strap guides through multiple uses, application of repeated force, and high stress. This can be especially important as the strap guides are positioned on the underside of second layer 112, where tensile element 132 can exert a strong downward pulling force on the strap guide. Thus, first reinforcing element 600 can bolster and augment the strength of the receiving channels of the strap guides.

In different embodiments, second layer 112 may include provisions for providing additional stability, support, or routing mechanism to first reinforcing element 600. For example, in some embodiments, third segment 606 of first reinforcing element 600 can be covered, protected, or otherwise inserted within a portion of second layer 112. In FIG. 6, a first tunnel portion 660 of second layer 112 is formed near the midline of second layer 112, generally midway between fourth strap guide 558 and fifth strap guide 620. First tunnel portion 660 can comprise a pocket, channel, tunnel, tube, or other type of snug receiving chamber in different embodiments through which a portion of first reinforcing element 600 can be extended. In some embodiments, first tunnel portion 660 can be integrally formed with second layer 112. In other embodiments, first tunnel portion 660 can comprise an additional piece of material added or joined to second layer 112 to form a channel.

Furthermore, second segment 604 and fourth segment 608 can comprise generally unattached, exposed, visible, or free portions of first reinforcing element 600. In other words, second segment 604 can be understood to extend from fourth strap guide 558 to a medial side end of first tunnel portion 660, and fourth segment 608 can be understood to extend from fifth strap guide 620 to a lateral side end of first tunnel portion 660. In other embodiments, first tunnel portion 660 may be longer and third segment 606 can have a greater length. In another embodiment, there may be no tunnel portions formed along second layer 112 and the length of first reinforcing element 600 extending between fourth strap guide 558 and fifth strap guide 620 may be entirely exposed or visible.

In different embodiments, components of tensioning system 120 such as first reinforcing element 600 or the guide elements described earlier can include various materials. In some embodiments, the materials comprising first reinforcing element 600 or a guide element can be substantially similar to those used for tensile element. In other embodiments, the materials may differ. For purposes of this disclosure, tensile elements, guide elements, and/or reinforcing elements may be formed from any generally one-dimensional material. As utilized with respect to the present invention, the term "one-dimensional material" or variants thereof is intended to encompass generally elongated materials exhibiting a length that is substantially greater than a width and a thickness. Accordingly, suitable materials for tensile elements, guide elements, and/or reinforcing elements include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra-high molecular weight polyethylene, liquid crystal polymer, copper, aluminum, and steel. Whereas filaments have an indefinite length and may be utilized individually as tensile elements, fibers have a relatively short length and generally go through spinning or twisting processes to produce a strand of suitable length. An individual filament utilized in the tensile element, guide elements, and/or reinforcing elements may be formed form a single material (i.e., a monocomponent filament) or from multiple materials (i.e., a bicomponent filament). Similarly, different filaments may be formed from different materials. As an example, yarns utilized as tensile elements, guide elements, and/or reinforcing elements may include filaments that are each formed from a common material, may include filaments that are each formed from two or more different materials, or may include filaments that are each formed from two or more different materials. Similar concepts also apply to threads, cables, or ropes. The thickness of tensile elements, guide elements, and/or reinforcing elements may also vary significantly to range from 0.03 millimeters to more than 15 millimeters, for example. Although one-dimensional materials will often have a cross section where width and thickness are substantially equal (e.g., a round or square cross section), some one-dimensional materials may have a width that is greater than a thickness (e.g., a rectangular, oval, or otherwise elongated cross section). Despite the greater width, a material may be considered one dimensional if a length of the material is substantially greater than a width and a thickness of the material. In addition, some portions of a tensile element, guide elements, and/or reinforcing elements can comprise brio cables in some embodiments. For example, in order to provide the desired reinforcement to strap guides, the material comprising a reinforcement element may partially or entirely use brio cables or other high tensile, lightweight, synthetic cable materials. In some embodiments, the tensile elements, guide elements, strap guides, and/or reinforcement elements described herein can comprise materials, features, or elements disclosed in Dojan, U.S. Pat. No. 9,113,674, issued on Aug. 25, 2015 (previously U.S. patent application Ser. No. 13/327,229, filed Dec. 15, 2011) and entitled "Footwear Having An Upper With Forefoot Tensile Strand Elements," Dojan et al., U.S. Pat. No. 8,266,827, issued on Sep. 18, 2012 (previously U.S. patent application Ser. No. 12/546,022) and entitled "Article Of Footwear Incorporating Tensile Strands and Securing Strands," and Meschter, U.S. Pat. No. 7,574,818, issued on Aug. 18, 2009 (previously U.S. patent application Ser. No. 11/442,669, filed on May 25, 2006) and entitled "Article Of Footwear Having An Upper With Thread Structural Elements," the disclosures of which are incorporated herein by reference in their entirety. As another example, if desired, the materials of tensioning system 120 material may include high-strength threads or other reinforcing and/or shape-defining structures at selected locations in the upper material construction (such as the high-strength thread used in various FLYWIRE™ footwear products available from NIKE, Inc. of Beaverton, Oreg., etc.).

Figure 7:
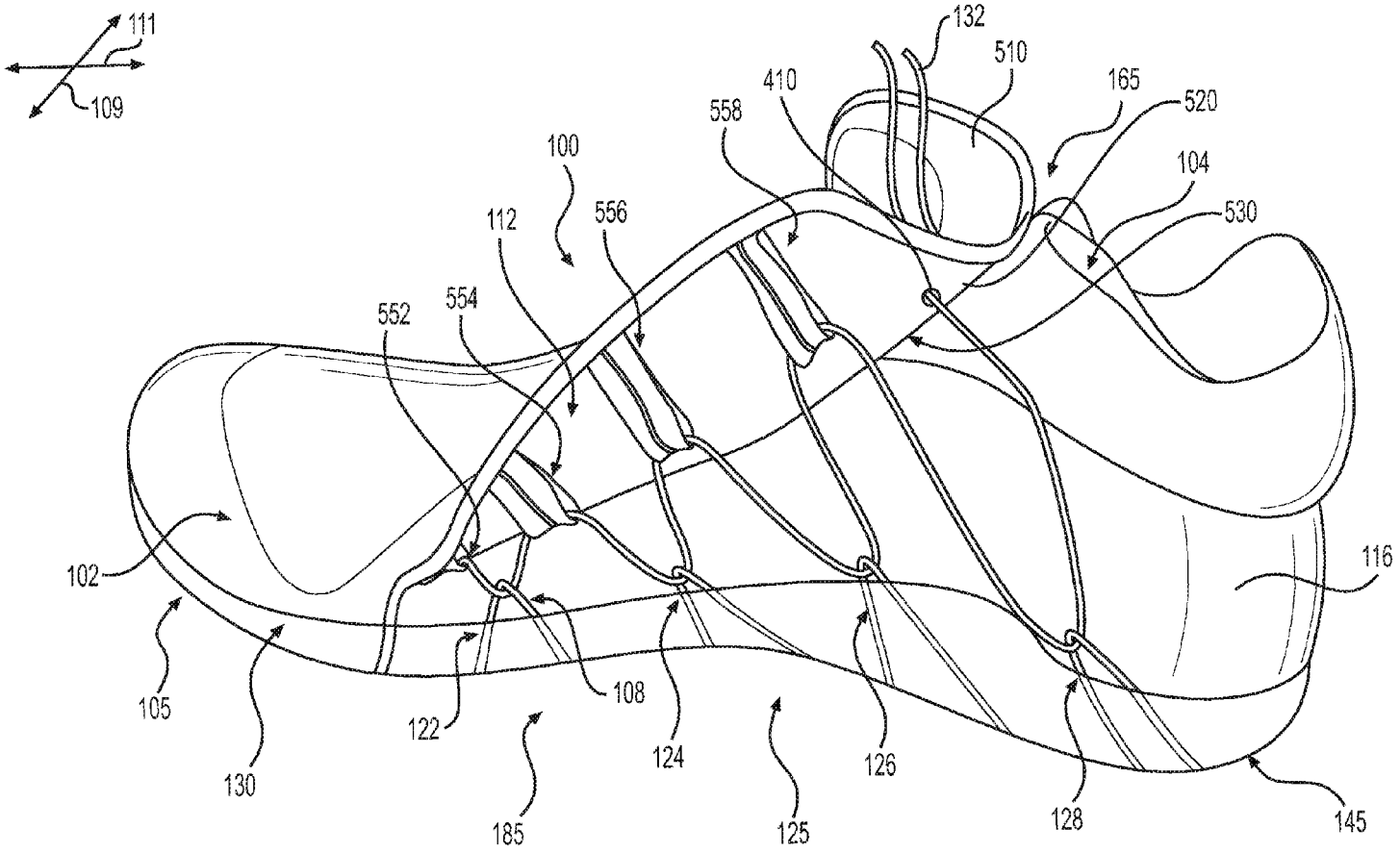
FIG. 7 is an isometric view of an embodiment of an article of footwear including a tensioning system as the tension is adjusted.

Thus, in different embodiments, tensioning system 120 may include provisions for securing tensile element 132, and/or for routing tensile element 132 in a specific orientation. In some embodiments of tensioning system 120, portions of tensile element 132 can extend from distal side 510 through apertures in second layer 112 (i.e., first aperture 410 and second aperture 420 as shown in FIGS. 4 and 6) and be routed through different elements of tensioning system 120. These elements can include various guide elements 108 (see FIGS. 1 and 2) and/or strap guides 550 (see FIGS. 5 and 6). One example of a routing arrangement on the medial side of article 100 is depicted in FIG. 7. In FIG. 7, tensile element 132 can be seen extending from distal side 510, through the thickness of second layer 112 along first aperture 410, and continuing between proximal side 520 and distal surface 530 of first layer 116. Tensile element 132 is then routed downward toward sole structure 130 and into the loop associated with fourth guide element 128, from which it emerges and extends upward toward second layer 112 to be routed through the channel formed within fourth strap guide 558. Tensile element 132 continues from fourth strap guide 558 in a downward direction toward sole structure 130, and into the loop associated with third medial guide 126, from which it emerges and extends upward toward second layer 112 to be routed through the channel formed within third strap guide 556. In addition, tensile element 132 can then extend from third strap guide 556 in a downward direction toward sole structure 130, and into the loop associated with second medial guide 124, from which it emerges and extends upward toward second layer 112 to be routed through the channel formed within second strap guide 554. From second strap guide 554, tensile element 132 emerges to extend in a downward direction into the loop of first medial guide 122, from which it again extends upward into first strap guide 552. In other words, in some embodiments, tensile element 132 can be routed through multiple looped guides in a zig-zag or undulating manner, extending generally in a direction substantially aligned with longitudinal axis 111.

In some embodiments, following its routing across medial side 185, tensile element 132 can continue to be routed across a central portion of upper 102, in a direction substantially aligned with lateral direction 109. In one embodiment, first layer 116 may include an additional routing strap (see FIG. 9) to facilitate the routing of tensile element 132 from medial side 185 to lateral side 165. In the embodiments depicted herein, lateral side 165 of article 100 includes a substantially similar lacing arrangement as that described with respect to medial side 185. In other words, the lacing arrangement may be substantially symmetrical on the medial and lateral sides of the article in some embodiments, as shown here. However, in other embodiments, the routing of tensile element 132 along lateral side 165 may differ from that depicted herein for medial side 185.

Figure 8:
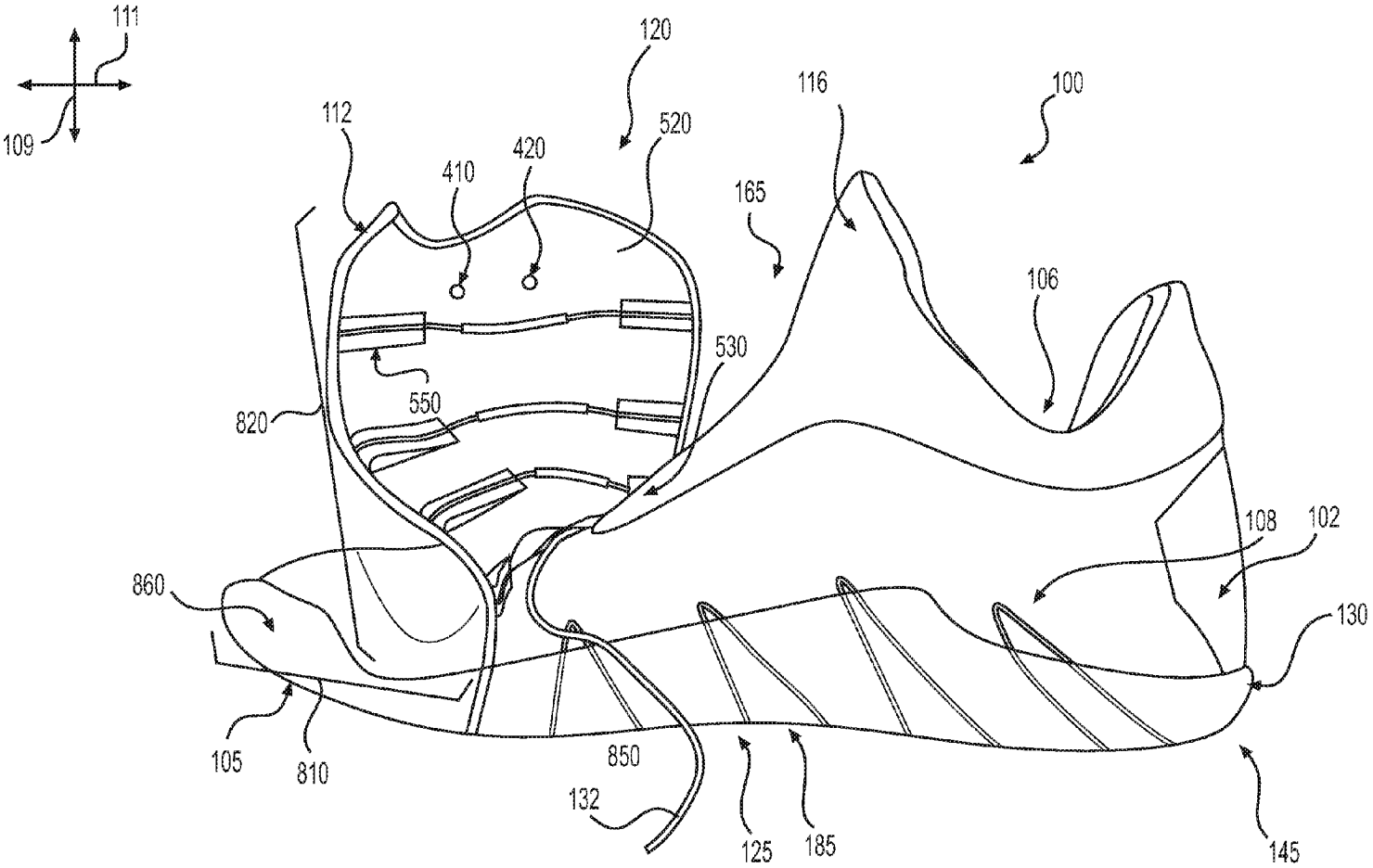
FIG. 8 is an isometric view of an embodiment of an article of footwear including a tensioning system as the tension is adjusted.

FIG. 8 provides an example of a possible loosened or open configuration for article 100. In the open configuration, it can be seen that second layer 112 can be pulled forward toward forefoot region 105 in some embodiments, permitting a fully untensioned configuration for the bootie-like structure comprising first layer 116. Thus, in FIG. 8, first layer 116 is expanded to a maximum volume. In some embodiments, open state represents article 100 when interior cavity 106 is most capable of readily and comfortably receiving a foot. In FIG. 8, upper 102 is in the open state, such that a foot would not necessarily be secure within article 100. In different embodiments, in order to transition article 100 back to a closed state, laces (if removed) can be rerouted as described herein. Furthermore, a pulling force can be exerted on the end portions of tensile element 132 to reduce the slack and tighten upper 102.

In one embodiment, the fully loosened state can be facilitated by the ability of second layer 112 to be pulled away from or be freed from contact with first layer 116. In some embodiments, second layer 112 can comprise a flap portion 820 and an anchored portion 810, where flap portion 820 comprises a substantially free or unattached portion of second layer 112, and anchored portion 810 is joined or connected to first layer 116. In some embodiments, anchored portion 810 is fixedly attached to first layer 116, and can provide a type of hinge region about which flap portion 820 can be configured to swivel. In some embodiments, only some portions of anchored portion 810 are fixedly attached to first layer 116. For example, in FIG. 8, a peripheral border 860 of anchored portion 810 is fixedly attached to first layer 116, while a center portion 850 remains unattached or free of first layer 116. Thus, in some embodiments, center portion 850 of second layer 112 can accommodate additional components or materials between proximal side 520 and distal surface 530.

Thus, in some embodiments, it can be seen that only the inward-facing surface of second layer 112 (proximal side 520) includes fastening elements, while the distal side is relatively smooth. Referring back to FIGS. 1-3, article 100 may include a substantially "hidden" or covered fastening system, where the strap guides are disposed underneath second layer 112 and are not generally visible in the closed state. Furthermore, a majority of the lacing or tensile element 132 is arranged beneath second layer 112 in the closed state and also "hidden" or generally not visible. In other words, when a user wears article 100, a substantial majority of the instep and vamp regions are free of lacing, and the majority of article 100 appears to have a smooth external or outward-facing surface. In some embodiments, this can allow a user to engage in various activities such as high-contact sports (e.g., basketball, wrestling, football) and decrease the likelihood of article 100 being caught or snagged by an external component. In addition, by covering the majority of tensile element 132 with distal side 510 of second layer 112, tensile element 132 can be protected over long-term or repeated use, increasing the longevity of tensioning system 120 and its effectiveness in providing tension to article 100.

In addition, during walking, running, or other ambulatory activities, a foot within the interior cavity of an article may tend to stretch upper 102. That is, many of the material elements forming upper 102 may stretch when placed in tension by movements of the foot. Although some portions of tensioning system 120 may also stretch, tensile element 132, guide elements 108, and strap guides 550 generally stretch to a lesser degree than the other material elements forming upper 102 (e.g., first layer 116 and/or second layer 112). In some embodiments, tensile element 132 and corresponding guide elements 108, and strap guides 550 may be arranged to provide structural components in upper 102 that (a) resist stretching in specific directions or locations, (b) limit excess movement of the foot relative to sole structure 130 and upper 102, (c) ensure that the foot remains properly positioned relative to sole structure 130 and upper 102, (d) reinforce locations where forces are concentrated, and/or (e) exert a compressive wraparound tension around portions of upper 102 to snugly secure a foot in article 100.

As described above, in some embodiments, article 100 includes upper 102 that can comprise several layers. Furthermore, tensioning system 120 of article 100 may include various tensile or routing components that may contact different layers of upper 102 and/or sole structure 130. Each layer of upper 102 and portions of the tensioning system can be designed to extend around or interact with various regions along article 100. This arrangement can be observed in FIG. 9, which comprises is an exploded isometric view of one embodiment of article 100. Sole structure 130 is disposed nearest to the bottom, while the layers comprising upper 102 are disposed above.

Figure 9:
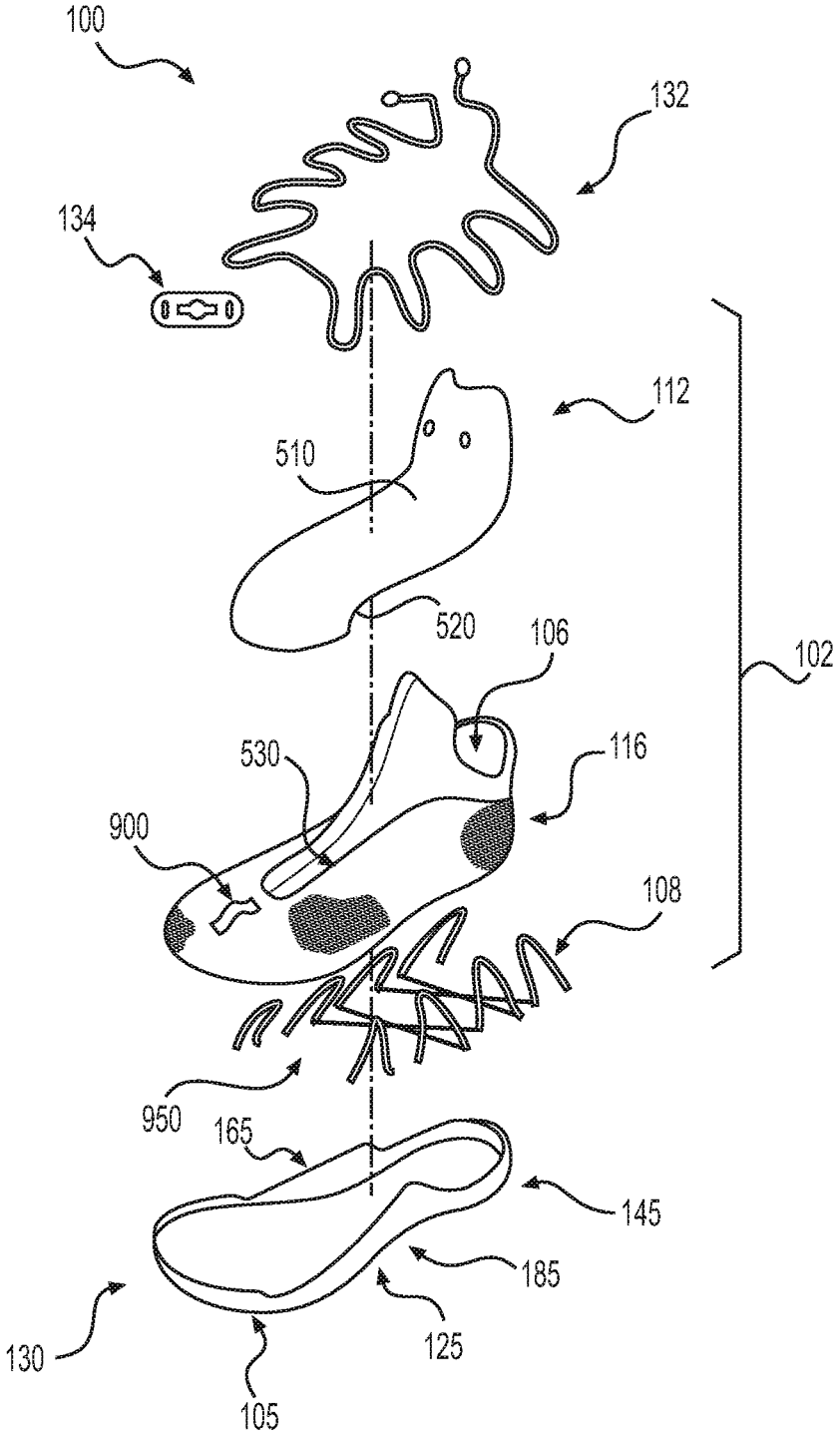
FIG. 9 is an exploded view of an embodiment of an article of footwear.

As noted previously, first layer 116 can be configured to form interior cavity 106 for insertion of a wearer's foot. Disposed adjacent to and above first layer 116 is second layer 112, described above with respect to FIGS. 1-8. In one embodiment, second layer 112 is disposed further from interior cavity 106 than first layer 116. Furthermore, as shown in FIG. 9, portions of the tensioning system can be disposed between layers. In one embodiment, a routing strap 900 comprising a looped or folded strap-like material, can be fixedly attached to first layer 116, as discussed previously. Routing strap 900 can be located in forefoot region 105 or midfoot region 125. In one embodiment, routing strap 900 is disposed beneath the anchored portion of second layer 112 (see FIG. 8) when article 100 is assembled.

In addition, though not shown here, strap guides can be fixedly attached to proximal side 520 of second layer 112. In some embodiments, tensile element 132 may be routed through the plurality of strap guides and guide elements and have an undulating arrangement, as discussed above. Furthermore, clasp mechanism 134 is shown adjacent to second layer 112, configured to receive and secure portions of tensile element 132.

As noted with respect to strap guides, in some embodiments, some portions of the fastening system may not be visible when article 100 is assembled. For example, it can be seen that in some embodiments, guide elements 108 can include segments that extend beneath upper 102. In other words, in some embodiments, there can be portions of guide elements 108 that are disposed or "sandwiched" between upper 102 and sole structure 130. Referring to FIG. 9, some guide elements 108 include a bridge portion 950. For purposes of this disclosure, bridge portion 950 refers to portions of one or more guide elements that extend beneath upper 102. In some embodiments, bridge portion 950 may connect or join or bridge one guide element to another guide element. Thus, in FIG. 9, bridge portion 950 comprises of four strands, each extending continuously from one end of a guide element and joining a guide element on the opposite side of article 100. It should be understood that while bridge portion 950 is identified for purposes of reference as a distinct portion of some guide elements 108, in some embodiments, bridge portion 950 can represent the same material as a first guide element as it extends underneath upper 102 and then wraps upward along the opposing side of upper 102, forming a second guide element. Bridge portion 950 will be discussed in greater detail with respect to FIG. 11.

Figure 10:
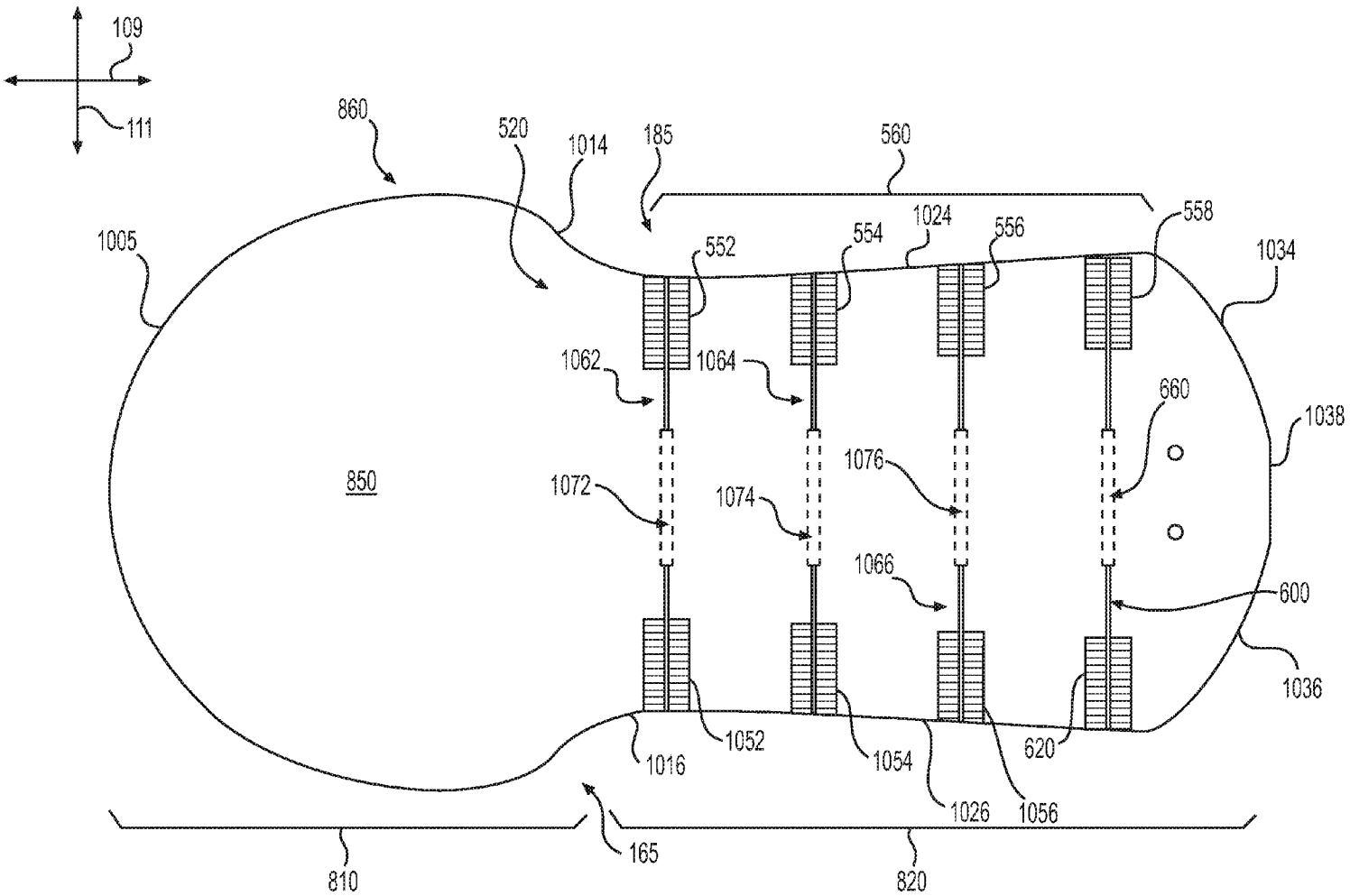
FIG. 10 is a schematic view of an embodiment of a layer for an article of footwear.

During different activities, article 100 may include provisions for dispersing the amount of force directed to various regions of a foot through the tensioning system. In some embodiments, second layer 112 may be configured to protect or distribute forces around upper 102. Referring now to FIG. 10, proximal side 520 of second layer 112 is shown in isolation for purposes of illustration. While second layer 112 may be entirely removable in other embodiments, it should be understood that the isolated view provided in FIG. 10 is for illustrative purposes only, and that in the figures depicted herein, second layer 112 includes a portion that is fixedly attached to first layer 116 (anchored portion 810), as well as a portion that is unattached or free from first layer 116 (flap portion 820).

As discussed above, second layer 112 may include a plurality of strap guides 550 disposed adjacent to proximal side 520 of second layer 112. In FIG. 10, strap guides 550 comprise medial strap set 560, including first strap guide 552, second strap guide 554, third strap guide 556, and fourth strap guide 558, arranged along a direction substantially aligned with longitudinal axis 111 on medial side 185. Furthermore, strap guides comprise lateral strap set 1060, including fifth strap guide 620, a sixth strap guide 1056, a seventh strap guide 1054, and an eighth strap guide 1052, arranged along a direction substantially aligned with longitudinal axis 111 on lateral side 165. In addition, as discussed above with respect to FIG. 6 and first reinforcing element 600, second layer 112 may include provisions for providing additional stability, support, or routing mechanism to one or more reinforcing elements. For example, in some embodiments, a segment of a second reinforcing element 1066 can be covered, protected, or otherwise inserted within a second tunnel portion 1076 of second layer 112 near the midline of second layer 112, generally midway between third strap guide 556 and sixth strap guide 1056. Similarly, a segment of a third reinforcing element 1064 can be enclosed within a third tunnel portion 1074, and a segment of a fourth reinforcing element 1062 can be enclosed with a fourth tunnel portion 1072.

Second layer 112 can include provisions for facilitating attachment to the first layer and/or the sole structure in some embodiments. It can be seen in FIG. 10 that each portion comprises various edges, forming differently shaped and sized regions. For example, anchored portion 810 comprises peripheral border 860 that includes a forefoot edge 1005 extending around the lower part of second layer 112 to bound and define a generally round shape. Furthermore, anchored portion 810 includes a medial vamp edge 1014 joined to forefoot edge 1005 along medial side 185 and a lateral vamp edge 1016 joined to forefoot edge 1005 along lateral side 165. Each of medial vamp edge 1014 and lateral vamp edge 1016 are oriented such that when assembled with article 100, medial vamp edge 1014 and lateral vamp edge 1016 will extend in a direction substantially aligned with a vertical axis (the up-down axis, extending between a sole structure and an upper). In some embodiments, forefoot edge 1005, medial vamp edge 1014, and lateral vamp edge 1016 can be fixedly attached to the first layer and/or sole structure, while center portion 850 of anchored portion 810 remains unattached.

In addition, flap portion 820 can comprise various edges associated with different portions of article 100 in the closed state. For example, in FIG. 10, flap portion 820 has a medial instep edge 1024 joined to medial ankle edge 1034, which extends toward a middle region to form a central ankle edge 1038. Similarly, central ankle edge 1038 extends toward lateral side 165 to form a lateral ankle edge 1036, which extends further forward to form a lateral instep edge 1026. Each of medial instep edge 1024 and lateral instep edge 1026 are oriented such that when assembled with article 100, medial instep edge 1024 and lateral instep edge 1026 will extend in a direction substantially aligned with longitudinal axis 111. In some embodiments, medial instep edge 1024 and lateral instep edge 1026 are substantially parallel to one another. Thus, in some embodiments, one or more reinforcing elements (e.g., first reinforcing element 600) extends from a medial edge (here, medial instep edge 1024) of second layer 112 to a lateral edge (here, lateral instep edge 1026) of second layer 112.

In addition, each of medial ankle edge 1034 and lateral ankle edge 1036 are oriented such that when assembled with article 100, medial ankle edge 1034 and lateral ankle edge 1036 will extend in a direction substantially diagonal with respect to longitudinal axis 111 and lateral axis 109. Furthermore, medial ankle edge 1034 and lateral ankle edge 1036 will extend in a generally upward direction, adjacent to the ankle region of the article. Similarly, central ankle edge 1038 is oriented such that when assembled with article 100 central ankle edge 1038 extends in a direction substantially aligned with lateral axis 109 and adjacent to the ankle region of the article.

Furthermore, in some cases, second layer 112 may have a width that is generally constant throughout second layer 112. In other embodiments, as shown in FIG. 10, second layer 112, may vary in width along one portion relative to another portion. For example, the average width of anchored portion 810 is greater than the average width of flap portion 820 in FIG. 10. Thus, in some embodiments, second layer 112 could only extend partially across the width of the full upper over the lateral direction.

In different embodiments, the degree of compression that portions of second layer 112 may withstand from a given force can vary according to factors including, but not limited to, desired cushioning properties, upper materials, the geometry of second layer 112 as well as possibly other factors. Second layer 112 may also include provisions for drainage, breathability, quick drying, and/or ventilation in some embodiments. Thus, in different embodiments, second layer 112 may be configured to help mitigate the effect of various forces applied to the instep portion of a foot. In FIGS. 1-3, when second layer 112 is fully engaged with first layer 116 (wherein upper 102 is in the closed state), vamp region 115, instep region 135, and ankle region 155 of upper 102 can be securely wrapped around at least a portion of a user's foot by tensioning system 120 as disclosed herein. In some embodiments, a hoop stress or circumferential stress may be applied over the area of a user's foot forward of the ankle through utilization of tensioning system 120. In FIGS. 1-3, a sustained compressive tension can be transmitted or distributed throughout the various elements of tensioning system 120. In one embodiment, a user may be able to readily increase the snug fit of an article with a relatively simple pulling step along clasp mechanism 134. Tensioning system 120 may also allow a user to apply a compressive force around vamp region 115, instep region 135, and ankle region 155 of article 100 in some embodiments.

Furthermore, it should be understood that depending upon the specific configuration of article 100 and the intended use of article 100, first layer 116 and/or second layer 112 may be non-stretch materials, materials with one directional stretch, or materials with two-directional stretch, for example. In general, forming the layers of upper 102 from materials with two-directional stretch provides upper 102 with a greater ability to conform to the contours of the foot, thereby enhancing the comfort of article 100. In configurations where one or more of the layers have two-directional stretch, the combination of tensile element 132 with the layers can effectively vary the stretch characteristics of upper 102 in specific locations. Accordingly, in some embodiments, the overall stretch and tension characteristics of particular areas of upper 102 may be controlled by tensioning system 120.

Figure 11:
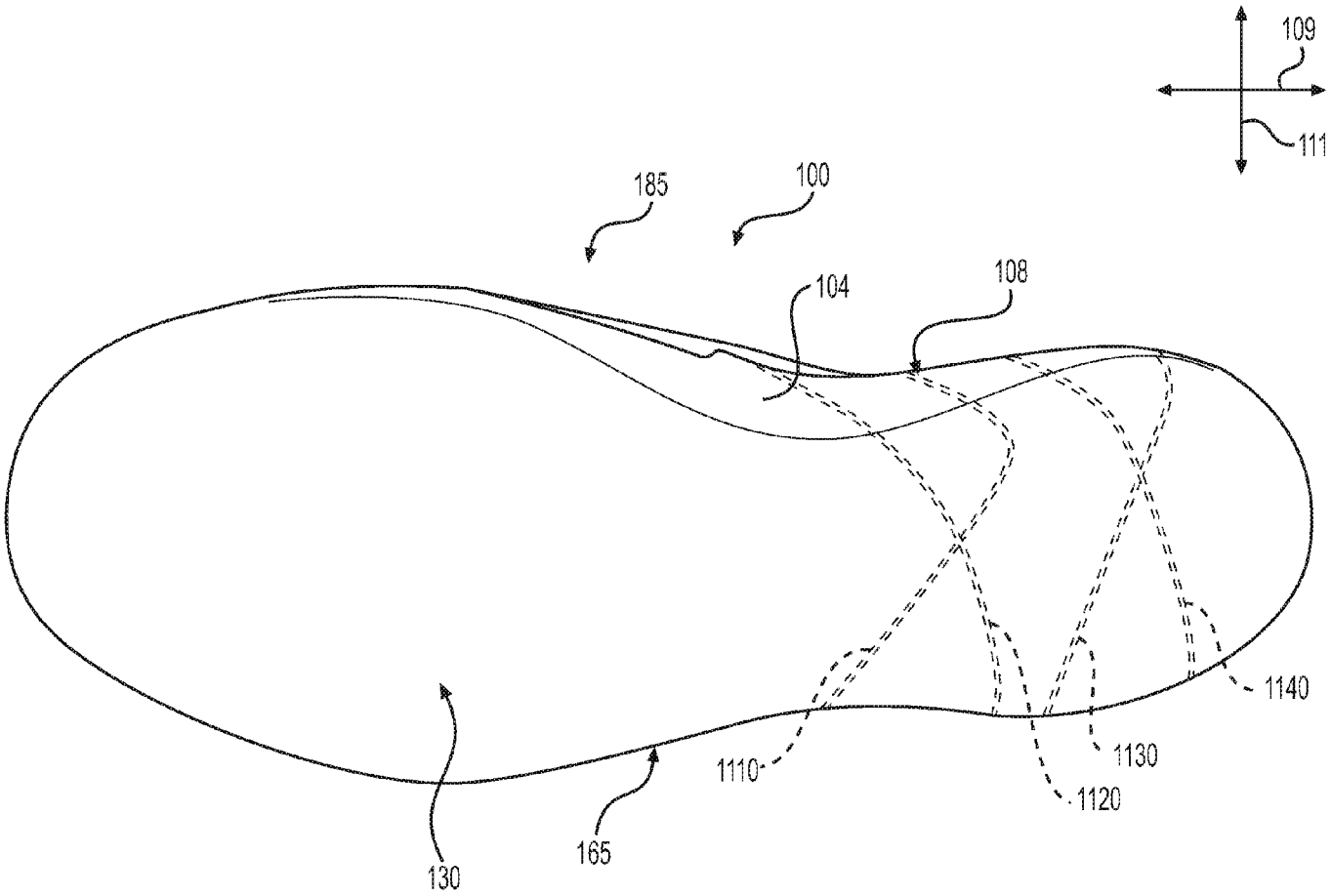
FIG. 11 is an isometric bottom view of an embodiment of an article of footwear including a sole structure.

In FIG. 11, a bottom-side view of sole structure 130 is illustrated. As noted with respect to FIG. 9, in some embodiments, there may be components of the fastening system that extend beneath the upper, or between the upper and sole structure 130. FIG. 11 includes several bridge portions extending diagonally in a direction generally aligned with lateral axis 109 from a guide element formed on medial side 185 to a guide element formed on lateral side 165. As an example, FIG. 11 depicts a first bridge portion 1110, a second bridge portion 1120, a third portion 1130, and a fourth bridge portion 1140 are shown in dotted lines, extending between lateral side 165 and medial side 185. Thus, in some embodiments, there may be elements of the fastening system that extend continuously along the lateral direction from medial side 185 to lateral side 165 along the underside of the upper.

Figure 12:
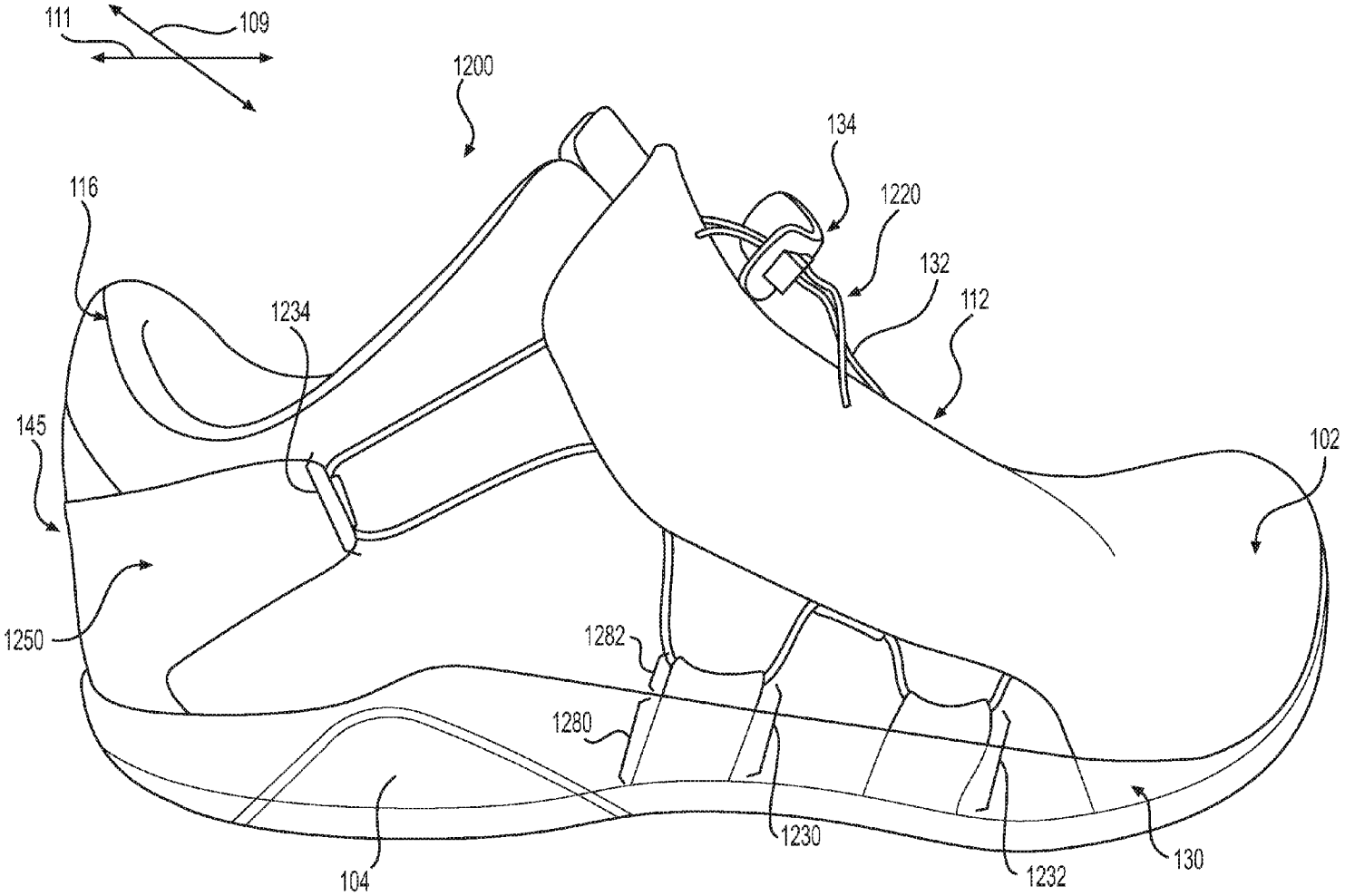
FIG. 12 is an isometric view of an embodiment of an article of footwear including a tensioning system.

In other embodiments, alternative mechanisms or elements may be included in a fastening system. As one example, FIG. 12 depicts a second article of footwear ("second article") 1200 with a second fastening system 1220. Second fastening system 1220 includes first layer 116 and second layer 112, which may be understood to be substantially similar to first layer and second layer as described above. However, rather than looped guide elements attached to the sides of upper 102, some embodiments can include folded straps that can route tensile element 132. For example, second article 1200 includes a first folded strap 1230 and a second folded strap 1232. Each folded strap can comprise a free portion 1282 and a fixed portion 1280. Fixed portion 1280 comprises the portion of each folded strap that is fixedly attached to upper 102. Fixed portion 1280 may provide greater reinforcement to second fastening system 1220. Further, fixed portion 1280 can act as an anchoring region for second fastening system 1220 in some embodiments. In FIG. 12, fixed portion 1280 is also disposed beneath sidewall 104 of sole structure 130. In other words, in some embodiments, fixed portion 1280 may be disposed between an outermost or distal surface of upper 102 and sidewall 104. Free portion 1282 may comprise a substantially folded region of the strap, and includes a channel or opening. In different embodiments, free portion 1282 of folded straps may be used to position or direct a portion of tensile element 132 along a specific orientation.

Furthermore, second fastening system 1220 can include a heel reinforcement 1250 that can be a substantially two-dimensional material that is sized and dimensioned to provide a wraparound compressive force along heel region 145. Heel reinforcement 1250 can extend around heel region 145 along both the medial and lateral sides of second article 1200 in some embodiments. In addition, heel reinforcement 1250 can include an anchoring portion 1234 in some embodiments. Anchoring portion 1234 can provide a securing region in which a portion of tensile element 132 can be routed or fixedly attached. In other words, in some embodiments, tensile element 132 may be routed through anchoring portion 1234 and be free to move through the region. However, in other embodiments, tensile element 132 can be fixedly attached beneath anchoring portion 1234, and provide a point of stability and reinforcement to second fastening system 1220. In addition, when a user tightens upper 102, heel reinforcement 1250 can be pulled against the foot and provide a more snug fit around the foot of a wearer.

This description of features, systems, and components is not intended to be exhaustive, and in other embodiments, the article may include other features, systems, and/or components. Moreover, in other embodiments, some of these features, systems, and/or components could be optional. As an example, some embodiments may not include reinforcing elements or a sidewall of the sole structure.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, the article of footwear comprising:

a lateral side, a medial side, a forefoot region, and an instep region;

an upper and a fastening system;

the upper comprising a first layer and a second layer;

wherein the first layer forms an interior cavity configured to receive a foot;

wherein the second layer includes a flap portion and an anchored portion, wherein a peripheral border of the anchored portion is attached to the first layer in the forefoot region, and further wherein a routing strap is attached to the first layer in the forefoot region beneath the anchored portion of the second layer;

the fastening system comprising a plurality of guide elements, a plurality of strap guides, and a tensile element;

the upper including a closed configuration and an open configuration;

the tensile element being routed through each of the plurality of strap guides and through each of the plurality of guide elements when the upper is in the closed configuration;

the second layer exerting a compressive force along at least a part of the instep region when the upper is in the closed configuration; and the plurality of strap guides being disposed between the first layer and the second layer.

2. The article of footwear according to claim 1, wherein the first layer comprises a bootie portion.

3. The article of footwear according to claim 1, wherein a reinforcing element is attached to each of the plurality of strap guides.

4. The article of footwear according to claim 3, wherein the reinforcing element comprises a cable.

5. The article of footwear according to claim 1, wherein each of the plurality of guide elements comprises a looped strand.

6. The article of footwear according to claim 1, wherein at least a portion of the plurality of guide elements extends between the upper and the sole structure.

7. An article of footwear, comprising:

an upper including a bootie portion and a cover layer:

the bootie portion including an interior cavity configured to receive a foot;

the cover layer positioned over a distal surface of the bootie portion so that the cover layer extends over at least a portion of an instep region of the article of footwear, wherein a plurality of guide elements are attached to the distal surface of the bootie portion and at least a portion of the plurality of guide elements is disposed between the upper and a sole structure;

a tensioning system, the tensioning system comprising a plurality of strap guides and a tensile element; and a heel reinforcement, the heel reinforcement including an anchoring portion, the tensile element being routed through the anchoring portion, the cover layer having a proximal surface and a distal surface, wherein the proximal side faces toward the distal surface of the bootie portion;

the plurality of strap guides being attached to the proximal surface of the cover layer;

the plurality of strap guides including a first strap guide and a second strap guide;

the first strap guide comprising of a first folded strap, the first folded strap being attached to a medial side of the proximal surface of the cover layer;

the second strap guide comprising of a second folded strap, the second folded strap being attached to a lateral side of the proximal surface of the cover layer;

the first folded strap including a first channel configured to receive a portion of the tensile element; and the second folded strap including a second channel configured to receive a portion of the tensile element.

8. An article of footwear, the article of footwear comprising:

a lateral side, a medial side, a forefoot region, and an instep region;

an upper and a fastening system;

the upper comprising a first layer and a second layer;

wherein the first layer forms an interior cavity configured to receive a foot;

wherein the second layer includes a flap portion and an anchored portion, wherein a peripheral border of the anchored portion is attached to the first layer in the forefoot region;

the fastening system comprising a plurality of guide elements, a plurality of strap guides, and a tensile element, wherein a reinforcing element is attached to each of the plurality of strap guides and the reinforcing element comprises a cable;

the upper including a closed configuration and an open configuration;

the tensile element being routed through each of the plurality of strap guides and through each of the plurality of guide elements when the upper is in the closed configuration;

the second layer exerting a compressive force along at least a part of the instep region when the upper is in the closed configuration; and the plurality of strap guides being disposed between the first layer and the second layer.

9. An article of footwear, comprising:

a sole structure;

an upper engaged with the sole structure, wherein the upper is changeable between an open configuration and a closed configuration and includes:

a first layer that extends through a forefoot region, a midfoot region, and a heel region of the upper, wherein the first layer includes an inner surface and an outer surface, and a second layer having an inner surface and an outer surface, wherein the second layer is positioned over the outer surface of the first layer and forms at least a portion of an instep region of the article of footwear, wherein the second layer includes an anchored end fixedly attached to the first layer at a forefoot portion of the first layer and an unfixed end opposite the anchored end, and wherein a first aperture and a second aperture are defined through the second layer proximate to the unfixed end;

a tensile element having a first end and a second end;

a plurality of guide elements positioned adjacent to a periphery of the first layer of the upper;

a plurality of tensile element guides attached to the inner surface of the second layer; and a first clasp mechanism, wherein the tensile element routes: (a) between the outer surface of the first layer and the inner surface of the second layer, (b) through the plurality of guide elements, and (c) through the plurality of tensile element guides, wherein the first end of the tensile element extends through the first aperture and the second end of the tensile element extends through the second aperture, wherein the first end and the second end of the tensile element extend through the first clasp mechanism, and wherein when the upper is in the closed configuration, the first clasp mechanism is positioned adjacent to the outer surface of the second layer in the instep region of the article of footwear and over the first aperture and the second aperture.

10. The article of footwear according to claim 9, wherein the plurality of guide elements includes: (a) a first folded strap having a fixed portion located between the first layer and the sole structure and a free portion extending outward from a location between the first layer and the sole structure at a lateral side of the article of footwear and (b) a second folded strap having a fixed portion located between the first layer and the sole structure and a free portion extending outward from a location between the first layer and the sole structure at a medial side of the article of footwear, wherein the tensile element extends through the first folded strap and the second folded strap.

11. The article of footwear according to claim 10, wherein the plurality of guide elements further includes: (a) a third folded strap having a fixed portion located between the first layer and the sole structure and a free portion extending outward from a location between the first layer and the sole structure at the lateral side of the article of footwear and rearward from the first folded strap and (b) a fourth folded strap having a fixed portion located between the first layer and the sole structure and a free portion extending outward from a location between the first layer and the sole structure at the medial side of the article of footwear and rearward from the second folded strap, wherein the tensile element extends through the third folded strap and the fourth folded strap.

12. The article of footwear according to claim 11, wherein the plurality of tensile element guides includes: (a) a first strap guide attached to the inner surface of the second layer at a lateral side of the second layer, (b) a second strap guide attached to the inner surface of the second layer at a medial side of the second layer, (c) a third strap guide attached to the inner surface of the second layer at the lateral side of the second layer and spaced from the first strap guide, and (d) a fourth strap guide attached to the inner surface of the second layer at the medial side of the second layer and spaced from the second strap guide, wherein the tensile element extends through the first strap guide, the second strap guide, the third strap guide, and the fourth strap guide.

13. The article of footwear according to claim 9, wherein the plurality of tensile element guides includes: (a) a first strap guide attached to the inner surface of the second layer at a lateral side of the second layer and (b) a second strap guide attached to the inner surface of the second layer at a medial side of the second layer, wherein the tensile element extends through the first strap guide and the second strap guide.

14. The article of footwear according to claim 13, wherein the plurality of tensile element guides further includes: (a) a third strap guide attached to the inner surface of the second layer at the lateral side of the second layer and spaced from the first strap guide and (b) a fourth strap guide attached to the inner surface of the second layer at the medial side of the second layer and spaced from the second strap guide, wherein the tensile element extends through the third strap guide and the fourth strap guide.

15. An article of footwear, comprising:

a sole structure;

an upper engaged with the sole structure, wherein the upper is changeable between an open configuration and a closed configuration and includes:

a first layer that forms an interior cavity configured to receive a foot, wherein the first layer includes an inner surface and an outer surface, and a second layer having an inner surface and an outer surface, wherein the second layer is positioned over the outer surface of the first layer and forms at least a portion of an instep region of the article of footwear, wherein the second layer includes an anchored portion fixedly attached to the first layer at a forefoot portion of the first layer and an unfixed portion opposite the anchored portion, and wherein a first aperture and a second aperture are defined through the second layer proximate to the unfixed portion;

a tensile element having a first end and a second end;

a plurality of guide elements positioned adjacent to a periphery of the first layer of the upper;

a plurality of tensile element guides attached to the inner surface of the second layer; and a first clasp mechanism, wherein, in the closed configuration, the tensile element routes: (a) through the plurality of guide elements and (b) through the plurality of tensile element guides, wherein the first end of the tensile element extends through the first aperture and the second end of the tensile element extends through the second aperture, wherein the first end and the second end of the tensile element extend through the first clasp mechanism, and wherein when the upper is in the closed configuration, the first clasp mechanism is positioned adjacent to the outer surface of the second layer in the instep region of the article of footwear and over the first aperture and the second aperture.

16. The article of footwear according to claim 15, wherein the plurality of guide elements includes: (a) a first folded strap having a fixed portion located between the first layer and the sole structure and a free portion extending outward from a location between the first layer and the sole structure at a lateral side of the article of footwear and (b) a second folded strap having a fixed portion located between the first layer and the sole structure and a free portion extending outward from a location between the first layer and the sole structure at a medial side of the article of footwear, wherein the tensile element extends through the first folded strap and the second folded strap.

17. The article of footwear according to claim 16, wherein the plurality of guide elements further includes: (a) a third folded strap having a fixed portion located between the first layer and the sole structure and a free portion extending outward from a location between the first layer and the sole structure at the lateral side of the article of footwear and (b) a fourth folded strap having a fixed portion located between the first layer and the sole structure and a free portion extending outward from a location between the first layer and the sole structure at the medial side of the article of footwear, wherein the tensile element extends through the third folded strap and the fourth folded strap.

18. The article of footwear according to claim 17, wherein the plurality of tensile element guides includes: (a) a first strap guide attached to the inner surface of the second layer at a lateral side of the second layer, (b) a second strap guide attached to the inner surface of the second layer at a medial side of the second layer, (c) a third strap guide attached to the inner surface of the second layer at the lateral side of the second layer and spaced from the first strap guide, and (d) a fourth strap guide attached to the inner surface of the second layer at the medial side of the second layer and spaced from the second strap guide, wherein the tensile element extends through the first strap guide, the second strap guide, the third strap guide, and the fourth strap guide.

19. The article of footwear according to claim 15, wherein the plurality of tensile element guides includes: (a) a first strap guide attached to the inner surface of the second layer at a lateral side of the second layer and (b) a second strap guide attached to the inner surface of the second layer at a medial side of the second layer, wherein the tensile element extends through the first strap guide and the second strap guide.

20. The article of footwear according to claim 19, wherein the plurality of tensile element guides further includes: (a) a third strap guide attached to the inner surface of the second layer at the lateral side of the second layer and spaced from the first strap guide and (b) a fourth strap guide attached to the inner surface of the second layer at the medial side of the second layer and spaced from the second strap guide, wherein the tensile element extends through the third strap guide and the fourth strap guide.

21. The article of footwear according to claim 15, wherein the first layer of the upper includes a bootie defining an interior cavity configured to receive a foot.

* * * * *